US011692280B2

(12) United States Patent
Shinoda et al.

(10) Patent No.: US 11,692,280 B2
(45) Date of Patent: Jul. 4, 2023

(54) ELECTRODEPOSITION COATING METHOD AND ELECTRODEPOSITION COATING APPARATUS

(71) Applicant: MAZDA MOTOR CORPORATION, Hiroshima (JP)

(72) Inventors: Masafumi Shinoda, Hiroshima (JP); Hiroki Matsui, Kosai (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 332 days.

(21) Appl. No.: 16/963,640

(22) PCT Filed: Jan. 15, 2019

(86) PCT No.: PCT/JP2019/000886

§ 371 (c)(1),
(2) Date: Jul. 21, 2020

(87) PCT Pub. No.: WO2019/146445

PCT Pub. Date: Aug. 1, 2019

(65) Prior Publication Data

US 2021/0062357 A1 Mar. 4, 2021

(30) Foreign Application Priority Data

Jan. 26, 2018 (JP) ..... JP2018-011695

(51) Int. Cl.
*C25D 13/22* (2006.01)
*C25D 13/10* (2006.01)
(Continued)

(52) U.S. Cl.
CPC ..... *C25D 13/22* (2013.01); *C25D 13/10* (2013.01); *C25D 13/20* (2013.01); *C25D 13/24* (2013.01)

(58) Field of Classification Search
CPC ..... C25D 13/22; C25D 13/10; C25D 13/20; C25D 13/24; C25D 13/04; C23C 22/66;
(Continued)

(56) References Cited

U.S. PATENT DOCUMENTS

2002/0185199 A1* 12/2002 Myers ..... A01N 59/16 148/537

FOREIGN PATENT DOCUMENTS

| | | | |
|---|---|---|---|
| JP | H108291 | A | 1/1998 |
| JP | 2010100906 | A | 5/2010 |
| JP | 2018016867 | A | 2/2018 |

OTHER PUBLICATIONS

International Search Report issued in PCT/JP2019/000886; dated Feb. 26, 2019.

* cited by examiner

*Primary Examiner* — Xiuyu Tai
(74) *Attorney, Agent, or Firm* — Studebaker & Brackett PC

(57) ABSTRACT

An electrodeposition coating method includes a degreasing/cleaning step, a chemical conversion step, and an electrodeposition coating layer formation step. The degreasing/cleaning step includes a degreasing step of ultrasonically vibrating a degreasing solution in which a target object is immersed, using an ultrasonic vibrator. The electrodeposition coating layer formation step includes: a first electrodeposition step; a first rinsing step; a rinse water removal/reduction step of removing or reducing rinse water on a rinse water stagnating surface of the target object; a thermal flow step of allowing the first electrodeposition coating film to thermally flow so that the first electrodeposition coating film formed on a portion of the target object near a first counter electrode has a higher electrical resistance than the first electrodeposition coating film formed on a portion of the
(Continued)

target object far from the first counter electrode; and a second electrodeposition step.

10 Claims, 14 Drawing Sheets

(51) Int. Cl.
*C25D 13/20* (2006.01)
*C25D 13/24* (2006.01)

(58) Field of Classification Search
CPC ..... C23C 22/12; C23C 22/82; C23C 22/13; C23C 22/78; C23C 22/83; C23C 22/56; C23C 22/73; C23C 22/361; C23C 22/07; C23C 22/182; C09D 5/12; C09D 5/14; C09D 7/61; C09D 7/63; C09D 163/00; C01B 25/372; C01B 25/37; C08K 5/57; C08K 3/04; A01N 59/16; A01N 25/34; A01N 25/26; A01N 25/10; A01N 2300/00; Y10T 428/12861; Y10T 428/31678; Y10T 428/12139
See application file for complete search history.

CONVENTIONAL EXAMPLE

CONVENTIONAL EXAMPLE

CONVENTIONAL EXAMPLE

CONVENTIONAL EXAMPLE

ELECTRODEPOSITION COATING METHOD AND ELECTRODEPOSITION COATING APPARATUS

TECHNICAL FIELD

The present invention relates to an electrodeposition coating method and an electrodeposition coating apparatus.

BACKGROUND ART

Electrodeposition coating has been widely adopted for the purpose of protecting metal products such as automotive bodies from corrosion. In the field of the electrodeposition coating, a problem to be addressed is to ensure throwing power when a target object has a complicated structure. For example, on an automotive body, an electrodeposition coating film of a predetermined thickness needs to be formed not only on an outer plate portion (outer surface) exposed to the outside, but also on an inner plate portion (inner surface) that is not exposed to the outside, such as a portion inside a passenger compartment, a portion inside an engine compartment, and an inner portion of a bag-shaped part. However, the inner plate portion of the automotive body is further away from counter electrodes (electrodes) of the electrodeposition coating apparatus than the outer plate portion, and has a low current density. This makes deposition of paint difficult, and the coating film tends to be thin. If the coating film is deposited up to a required thickness on the inner plate portion, the coating film on the outer plate portion becomes too thick.

As a countermeasure against the problem of the throwing power, a method of applying electrodeposition paint to the target object in two steps (so-called double coating method) has been known, as described in, for example, Patent Document 1. In this method, the target object is immersed in a first electrodeposition tank to form a first electrodeposition coating film and is rinsed, and the first electrodeposition coating film formed on an outer surface of the target object is caused to thermally flow. Then, the target object is immersed in a second electrodeposition tank to form a second electrodeposition coating film and is rinsed, and the first and second electrodeposition coating films are heated to cure. According to this method, for example, when the target body is an automotive body, holes are formed in the first electrodeposition coating film on the outer plate portion by hydrogen gas generated and discharged during the electrodeposition, and these gas holes are blocked through the thermal flow process. Thus, an electrical resistance of the outer plate portion increases. As a result, the inner plate portion is easily energized, causing the second electrodeposition coating film to further adhere to the inner plate portion. This makes it possible to form an electrodeposition coating film of a desired thickness on the inner plate portion, while keeping the coating film on the outer plate portion from thickening.

CITATION LIST

Patent Document

Patent Document 1: Japanese Unexamined Patent Publication No. H10-008291

SUMMARY OF THE INVENTION

Technical Problem

As a result of the present inventors' experiments and studies on the double coating method, it has been found that the following problems arise if the first electrodeposition coating film is caused to thermally flow with rinse water partially left thereon after rinsing the target object on which the first electrodeposition coating film has been formed.

FIG. 13A illustrates a state in which rinse water 103 adheres to a first electrodeposition coating film 102 on a target object 101. If the first electrodeposition coating film 102 is caused to thermally flow in this state, a recess 104 is formed at the boundary between a portion of the first electrodeposition coating film 102 which gets wet with the rinse water 103 and a dry portion to which no rinse water adheres as shown in FIG. 13B. This is because when heated during the thermal flow process, the dry portion of the first electrodeposition coating film 102 rapidly increases in temperature, but the portion that gets wet with the rinse water 103 slowly increases in temperature until the rinse water 103 evaporates. Specifically, this causes a difference in temperature between the wet portion and the dry portion, thereby causing a difference in volume shrinkage between these portions. The dry portion has a larger volume shrinkage than the wet portion. Thus, if the position of the boundary hardly moves, the first electrodeposition coating film is pulled toward the dry portion at the boundary, resulting in a relatively deep recess 104 at the boundary as shown in FIG. 13C.

When the second electrodeposition coating is performed (a second electrodeposition coating film 105 is formed) on the first electrodeposition coating film 102 with the recess 104 formed therein, the electrodeposition paint tends to adhere to the recess 104 which has a lower electrical resistance than the periphery thereof. As a result, as shown in FIG. 13D, a portion of the second electrodeposition coating film 105 corresponding to the boundary between the wet portion and the dry portion becomes locally thickened. That is, a projection 106 is formed.

Particularly on a substantially horizontal surface of the target object, e.g., a roof of an automotive body, the rinse water does not flow down, but tends to partially remain there due to surface tension. This makes the problem of unevenness more prominent.

The double coating method makes it possible to form an electrodeposition coating layer (including first and second electrodeposition coating films) having a desired thickness on a portion of the target object that is not exposed to the outside, while reducing an increase in thickness of the electrodeposition coating layer formed on a portion of the target object exposed to the outside. However, the electrodeposition coating layer on the portion exposed to the outside of the target object becomes relatively thin. Thus, if the electrodeposition coating film is formed on the surface of the target object on which dirt and an oil and fat content are still remaining even after a degreasing step, which is a pretreatment, the electrodeposition coating layer tends to have an uneven surface.

If the surface of the electrodeposition coating layer becomes uneven as described above, the finally obtained paint surface lacks smoothness even if a second coating and a final coating are formed on the electrodeposition coating layer, or the uneven surface of the electrodeposition coating layer, which is an undercoat, can be seen through the second and final coatings. This makes the appearance poor.

Further, according to the double coating method, the electrodeposition paint is applied to the target object in two steps, and the duration (time) of the step of forming the electrodeposition coating layer inevitably becomes longer than the duration of the conventional step of forming the electrodeposition coating film in which the electrodeposition coating is performed once. As a result, the entire duration of an electrodeposition coating line increases.

In view of the foregoing background, the present invention has been achieved, and it is an object of the present invention to provide an electrodeposition coating method and an electrodeposition coating apparatus capable of making the entire duration (time) of an electrodeposition coating line in which electrodeposition paint is applied to a target object in two steps substantially the same as the entire duration of a conventional electrodeposition line in which the electrodeposition coating is performed once, while keeping the electrodeposition coating layer from becoming uneven.

Solution to the Problems

In order to achieve the above object, the following electrodeposition coating method and electrodeposition coating apparatus are provided.

The electrodeposition coating method includes: a degreasing/cleaning step of removing dirt or an oil and fat content on a surface of a target object to be coated; a chemical conversion step, performed after the degreasing/cleaning step, of forming a chemical conversion layer on the surface of the target object from which the dirt or the oil and fat content has been removed; and an electrodeposition coating layer formation step, performed after the chemical conversion step, of forming an electrodeposition coating layer including a first electrodeposition coating film and a second electrodeposition coating film stacked on the first electrodeposition coating film on the surface of the target object on which the chemical conversion layer has been formed, wherein the degreasing/cleaning step includes a degreasing step of degreasing and cleaning the target object, from the surface of which the dirt or the oil and fat content has not been removed yet, through ultrasonically vibrating a degreasing solution which is stored in a degreasing tank and in which the target object is immersed, using an ultrasonic vibrator provided on a wall portion of the degreasing tank, and the electrodeposition coating layer formation step includes: a first electrodeposition step of forming, in a first electrodeposition tank, the first electrodeposition coating film on the target object through application of a direct current voltage between the target object on which the chemical conversion layer has been formed and a first counter electrode; a first rinsing step of rinsing, after the first electrodeposition step, the target object on which the first electrodeposition coating film has been formed with rinse water; a rinse water removal/reduction step of removing or reducing, after the first rinsing step, the rinse water remaining on a rinse water stagnating surface of the target object that has been rinsed, the rinse water stagnating surface being substantially horizontal and thus stagnating the rinse water thereon; a thermal flow step of allowing the first electrodeposition coating film to thermally flow after the rinse water removal/reduction step such that, on the target object having gone through the removal or reduction of the rinse water on the rinse water stagnating surface, the first electrodeposition coating film formed on a portion of the target object near the first counter electrode has a higher electrical resistance than the first electrodeposition coating film formed on a portion of the target object far from the first counter electrode; and a second electrodeposition step of forming, in a second electrodeposition tank after the thermal flow step, the second electrodeposition coating film on the target object on which the first electrodeposition film has thermally flowed, through application of a direct current voltage between the target object and a second counter electrode.

According to the electrodeposition coating method, in the electrodeposition coating layer formation step, the rinse water on the rinse water stagnating surface (where the rinse water for rinsing stagnates) of the target object is removed or reduced between the first rinsing step of rinsing the target object on which the first electrodeposition coating film has been formed and the thermal flow step. Thus, when the first electrodeposition coating film on the surface of the target object is caused to thermally flow thereafter, the surface of the first electrodeposition coating film can be kept from forming a recess therein. Even if the rinse water is not completely removed from the rinse water stagnating surface and partially remains thereon, the amount of the remaining rinse water is small. Thus, the rinse water rapidly evaporates through the heating for causing the thermal flow in the thermal flow step following the first rinsing step. That is, during the thermal flow, a large difference in volume shrinkage between the wet portion and dry portion of the first electrodeposition coating film does not last for a long time. This avoids the formation of the recess at the boundary between the wet portion and the dry portion. Even if the recess is formed, its depth is small. Thus, the second electrodeposition coating film formed after the thermal flow can be kept from becoming greatly uneven.

In addition, in the degreasing/cleaning step (degreasing step), the target object, from the surface of which the dirt or the oil and fat content has not been removed yet, is degreased and cleaned through ultrasonically vibrating the degreasing solution in the degreasing tank in which the target object is immersed, using the ultrasonic vibrator provided on the wall portion of the degreasing tank. This can sufficiently degrease and clean a portion of the target object not exposed to the outside, e.g., an inner portion of a bag-shaped part, in a short time, as compared to the rinsing using the pressure of sprayed water. Accordingly, in the electrodeposition coating layer formation step after the degreasing step, the electrodeposition coating layer can be kept from becoming uneven due to the dirt and the oil and fat content, and the duration (time) of the degreasing step can be shortened. Hence, even if the double coating method is employed, the entire duration (time) of the electrodeposition coating line can be made substantially equal to the entire duration of the conventional electrodeposition coating line in which the electrodeposition coating is performed once.

In a preferred embodiment of the electrodeposition coating method, the rinse water removal/reduction step is a step of blowing a gas to the rinse water stagnating surface to eliminate the rinse water from the rinse water stagnating surface.

Blowing the gas to the rinse water stagnating surface of the target object can remove or reduce the rinse water on the rinse water stagnating surface. This can satisfactorily keep the electrodeposition coating layer from becoming uneven.

In a preferred embodiment of the electrodeposition coating method, the first rinsing step includes: a dip-rinsing step of immersing the target object on which the first electrodeposition coating film has been formed in the rinse water stored in a dipping tank; and a spray-washing step of spraying, before or after the dip-washing step, the rinse water on the target object on which the first electrodeposition coating film has been formed.

The dip-rinsing step and the spray-rinsing step can sufficiently rinse the target object on which the first electrodeposition coating film has been formed. Thus, the subsequent rinse water removal/reduction step can be performed more effectively, which can satisfactorily keep the electrodeposition coating layer from becoming uneven.

In a preferred embodiment of the electrodeposition coating method, the first electrodeposition coating film is allowed to thermally flow in the thermal flow step through blowing warm air having a lower temperature than a baking temperature of the first electrodeposition coating film to the target object.

Thus, the thermal flow is caused in the thermal flow step through blowing the warm air having a temperature lower than the baking temperature of the first electrodeposition coating film to the target object. That is, the heating is performed not by radiation, but by the warm air. Therefore, the rinse water, if remaining on the surface of the first electrodeposition coating film, is quickly removed. This can keep the first electrodeposition coating film from forming a recess in its surface, and can keep the electrodeposition coating layer from becoming uneven more satisfactorily.

In a preferred embodiment, if the thermal flow is caused through blowing the warm air to the target object as described above, the first electrodeposition coating film is allowed to thermally flow in the thermal flow step such that the first electrodeposition coating film formed on the portion of the target object near the first counter electrode is heated at 70° C. to 100° C. for a predetermined time.

Here, if the first electrodeposition coating film formed on the portion of the target object near the first counter electrode is heated at a temperature lower than 70° C., or heated for a shorter time than the predetermined time, in the thermal flow step, the thermal flow of the first electrodeposition coating film on that portion occurs insufficiently, resulting in an insufficient increase in the electrical resistance of the first electrodeposition coating film on that portion. For this reason, in the formation of the second electrodeposition coating film, the second electrodeposition coating film is formed more easily on the portion of the target object near the first counter electrode. This is disadvantageous for the formation of the second electrodeposition coating film of a desired thickness on the portion of the target far from the first counter electrode. On the other hand, if the heating is performed at a temperature higher than 110° C., or for a longer time than the predetermined time, the first electrodeposition coating film which is thinly formed on the portion of the target object far from the first counter electrode becomes dense through the thermal flow, and in particular, increases its electrical resistance too much. This is disadvantageous for the formation of the second electrodeposition coating film on the portion far from the first counter electrode.

If the thermal flow is caused so that the first electrodeposition coating film formed on the portion of the target object near the first counter electrode is heated at 70° C. to 100° C. for a predetermined time, the electrodeposition coating layer having a desired thickness can be formed on the portions of the target object near and far from the first counter electrode. This can satisfactorily keep the electrodeposition coating layer from becoming uneven.

In a preferred embodiment of the electrodeposition coating method, the electrodeposition coating layer formation step includes a second rinsing step of rinsing, after the second electrodeposition step, the target object on which the second electrodeposition coating film has been formed with rinse water, and the electrodeposition coating method further includes, after the second rinsing step, a dehumidification step of sending the target object having the electrodeposition coating layer whose surface is wet with the rinse water to a dehumidification furnace, taking air out from the dehumidification furnace to lower humidity of the taken-out air while allowing the rinse water to fall in drops in the dehumidification furnace, and returning the air that has its humidity lowered to the dehumidification furnace, thereby drying the rinse water on the surface of the target object.

If the baking/drying of the electrodeposition coating layer is performed after the second rinsing step with the rinse water remaining on the surface of the target object (the surface of the electrodeposition coating layer), the surface of the electrodeposition coating layer becomes uneven, which makes the appearance poor. For this reason, the rinse water needs to be eliminated from the surface of the electrodeposition coating layer.

In the dehumidification step, the target object having the electrodeposition coating layer whose surface has got wet through the rinsing is sent to the dehumidification furnace to dry the rinse water. In the dehumidification furnace, the rinse water remaining on the surface of the target object naturally falls in drops by gravity, which can remove most of the remaining rinse water. Further, the air which has entered the dehumidification furnace is taken out to lower its humidity, and the air that has its humidity lowered is returned to the dehumidification furnace to lower the humidity in the dehumidifying furnace. This can gradually dry the moisture adhering to the surface of the target object without excessively increasing the surface temperature of the target object. This can keep the electrodeposition coating layer from having an uneven surface caused by traces of the remaining rinse water.

Further, in addition to the natural fall of the rinse water by gravity, the humidity in the dehumidification furnace is lowered to dry the rinse water remaining on the surface of the target object. Thus, the remaining rinse water can be removed more quickly than in the case where the rinse water is removed only through the natural fall by gravity. This can shorten the duration of the dehumidification step, and hence can easily make the entire duration of the electrodeposition coating line substantially the same as the entire duration of a conventional electrodeposition coating line in which the electrodeposition coating is performed once.

In a preferred embodiment, if the electrodeposition coating method includes the dehumidification step as described above, a heat pump is provided in advance, the heat pump using the air taken out from the dehumidification furnace as a heat absorption source, and the air cooled through heat absorption as a heat radiation source, and the dehumidification step includes: a cooling step of taking the air out from the dehumidification furnace and cooling the taken-out air using the heat pump such that part of moisture in the taken-out air is condensed as condensation water; and a heating step of heating the cooled air and returning the heated air to the dehumidification furnace using the heat pump.

The humidity in the dehumidification furnace can be lowered through exchanging the air in the dehumidification furnace with the outside air. However, this method leads to loss of energy because the high-temperature air is discharged to the outside.

In the present embodiment, the air taken out from the dehumidification furnace is cooled and heated using the heat pump, and the heated air is returned to the dehumidification furnace to dehumidify the dehumidification furnace. This can reduce the energy loss.

In a preferred embodiment, when the heat pump is used to cool and heat the air as described above, the drops and the condensation water are used as the rinse water in the second rinsing step.

Thus, the drops and the condensation water can be used as the rinse water in the second rinsing step which is the previous step, that is, the drops and the condensation water can be reused.

In a preferred embodiment, if the electrodeposition coating method includes the dehumidification step as described above, the air returned to the dehumidification furnace has a temperature lower than 100° C.

This can control the surface temperature of the target object sent to the dehumidification furnace to be lower than 100° C., which keeps the rinse water adhering to the surface of the target object from boiling. Since the rinse water generates no bubbles without boiling, no traces are left on the surface of the target object.

In an embodiment of the electrodeposition coating method, the target object is an automotive body, and the rinse water stagnating surface is a roof of the automotive body.

The electrodeposition coating apparatus includes: a degreasing/cleaning device that removes dirt or an oil and fat content on a surface of a target object to be coated; a chemical conversion device that forms a chemical conversion layer on the surface of the target object from which the dirt or the oil and fat content has been removed; and an electrodeposition coating layer formation device that forms an electrodeposition coating layer including a first electrodeposition coating film and a second electrodeposition coating film stacked on the first electrodeposition coating film on the surface of the target object on which the chemical conversion layer has been formed, wherein the degreasing/cleaning device includes a degreasing device that degreases and cleans the target object, from the surface of which the dirt or the oil and fat content has not been removed yet, through ultrasonically vibrating a degreasing solution which is stored in a degreasing tank and in which the target object is immersed, using an ultrasonic vibrator provided on a wall portion of the degreasing tank, the electrodeposition coating layer formation device includes: a first electrodeposition device that has a first electrodeposition tank, and forms, in the first electrodeposition tank, the first electrodeposition coating film on the target object on which the chemical conversion layer has been formed, through application of a direct current voltage between the target object and a first counter electrode; a first rinsing device that rinses the target object on which the first electrodeposition coating film has been formed with rinse water; a rinse water removal/reduction device that removes or reduces the rinse water remaining on a rinse water stagnating surface of the target object which has been rinsed, the rinse water stagnating surface being substantially horizontal and thus stagnating the rinse water thereon; a thermal flow device that allows the first electrodeposition coating film to thermally flow such that, on the target object having gone through the removal or reduction of the rinse water on the rinse water stagnating surface, the first electrodeposition coating film formed on a portion of the target object near the first counter electrode has a higher electrical resistance than the first electrodeposition coating film formed on a portion of the target object far from the first counter electrode; and a second electrodeposition device that has a second electrodeposition tank, and forms, in the second electrodeposition tank, the second electrodeposition coating film on the target object on which the first electrodeposition coating film has thermally flowed, through application of a direct current voltage between the target object and a second counter electrode.

The above-described configuration can provide the same advantages as those of the electrodeposition coating method.

In a preferred embodiment of the electrodeposition coating apparatus, the rinse water removal/reduction device has a blow nozzle that blows a gas to the rinse water stagnating surface to eliminate the rinse water from the rinse water stagnating surface.

This can provide the same advantages as those of the electrodeposition coating method in which the rinse water removal/reduction step is a step of blowing the gas to the rinse water stagnating surface.

In a preferred embodiment of the electrodeposition coating apparatus, the first rinsing device includes: a dipping tank that stores the rinse water in which the target object having the first electrodeposition coating film formed thereon is immersed; and a spray nozzle that sprays the rinse water on the target object having the first electrodeposition coating film formed thereon, before or after the immersion of the target object having the first electrodeposition coating film formed thereon in the dipping tank.

This can provide the same advantages as those of the electrodeposition coating method in which the first rinsing step includes the dip-rinsing step and the spray-rinsing step.

In a preferred embodiment of the electrodeposition coating apparatus, the thermal flow device is configured to blow warm air having a lower temperature than a baking temperature of the first electrodeposition coating film to the target object from which the rinse water has been removed or reduced.

This can provide the same advantages as those of the electrodeposition coating method in which the thermal flow is caused through blowing the warm air having a lower temperature than the baking temperature of the first electrodeposition coating film to the target object.

In a preferred embodiment, if the thermal flow device blows the warm air having a lower temperature than the baking temperature of the first electrodeposition coating film to the target object, the thermal flow device is configured to allow the first electrodeposition coating film to thermally flow such that the first electrodeposition coating film formed on the portion of the target object near the first counter electrode is heated at 70° C. to 100° C. for a predetermined time.

This can provide the same advantages as those of the electrodeposition coating method in which the thermal flow is caused such that the first electrodeposition coating film formed on the portion of the target object near the first counter electrode is heated at 70° C. to 100° C. for a predetermined time.

In a preferred embodiment of the electrodeposition coating apparatus, the electrodeposition coating layer formation device further includes a second rinsing device that rinses the target object on which the second electrodeposition coating film has been formed with rinse water, the electrodeposition coating apparatus further includes a dehumidifier that dries, after the rinsing of the target object by the second rinsing device, the rinse water on the surface of the target object rinsed by the second rinsing device, and the dehumidifier includes a dehumidification furnace to which the target object rinsed by the second rinsing device is sent, the dehumidifier being configured to take air out from the dehumidification furnace to lower humidity of the taken-out air while allowing the rinse water adhering to the target object to fall in drops in the dehumidification furnace, and return the air that has its humidity lowered to the dehumidification furnace, thereby drying the rinse water on the surface of the target object.

This can provide the same advantages as those of the electrodeposition coating method including the above-described dehumidification step.

In a preferred embodiment, if the electrodeposition coating apparatus includes the dehumidification furnace as described above, the dehumidifier includes: a cooler that receives the air taken out from the dehumidification furnace, and cools the received air such that part of moisture in the received air is condensed as condensation water; a heater that receives the air cooled by the cooler, and heats the received air; a circulation path that allows the air in the dehumidification furnace to circulate from the cooler to the heater to return to the dehumidification furnace; and a heat pump that connects the cooler and the heater so that a heating medium is able to circulate therebetween, the heat pump supplying, via the heating medium, cold thermal energy for cooling the air to the cooler and warm thermal energy for heating the air to the heater.

This can provide the same advantages as those of the electrodeposition coating method in which the air is cooled and heated using the heat pump.

In a preferred embodiment, if the electrodeposition coating apparatus includes the dehumidification furnace as described above, the electrodeposition coating apparatus further includes: a filter that removes dirt from the drops and the condensation water; and an ultrafiltration device into which the drops and the condensation water that have passed through the filter and returned to the second rinsing device are introduced from the second rinsing device via the second electrodeposition tank of the second electrodeposition device, wherein the ultrafiltration device recovers an electrodeposition paint from a solution containing the drops and the condensation water in the second electrodeposition tank.

According to this configuration, the drops and the condensation water contain almost no dust or dirt mixed from the outside. Thus, the dirt in the drops and the condensation water can be removed using a filter having a simple configuration. Then, the drops and the condensation water that have passed through the filter are returned to the second rinsing device, and then introduced from the second rinsing device to the ultrafiltration device via the second electrodeposition tank of the second electrodeposition device. The electrodeposition paint is recovered by the ultrafiltration device so that the electrodeposition paint can be reused.

In a preferred embodiment, if the electrodeposition coating apparatus includes the dehumidification furnace as described above, the air returned to the dehumidification furnace has a temperature lower than 100° C.

This can provide the same advantages as those of the electrodeposition coating method in which the air returned to the dehumidification furnace has a temperature lower than 100° C.

In an embodiment of the electrodeposition coating apparatus, the target object is an automotive body, and the rinse water stagnating surface is a roof of the automotive body.

Advantages of the Invention

As can be seen from the foregoing description, according to the electrodeposition coating method and electrodeposition coating apparatus of the present invention, in the case where the electrodeposition paint is applied to the target object in two steps, the entire duration of the electrodeposition coating line can be made substantially the same as the entire duration of a conventional electrodeposition line in which the electrodeposition coating is performed once, while keeping the electrodeposition coating layer from becoming uneven.

DESCRIPTION OF EMBODIMENT

An exemplary embodiment will be described below in detail with reference to the drawings. Note that the following description of the embodiment is merely an example in nature, and is not intended to limit the scope, applications, or use of the present invention.

Figure 1:
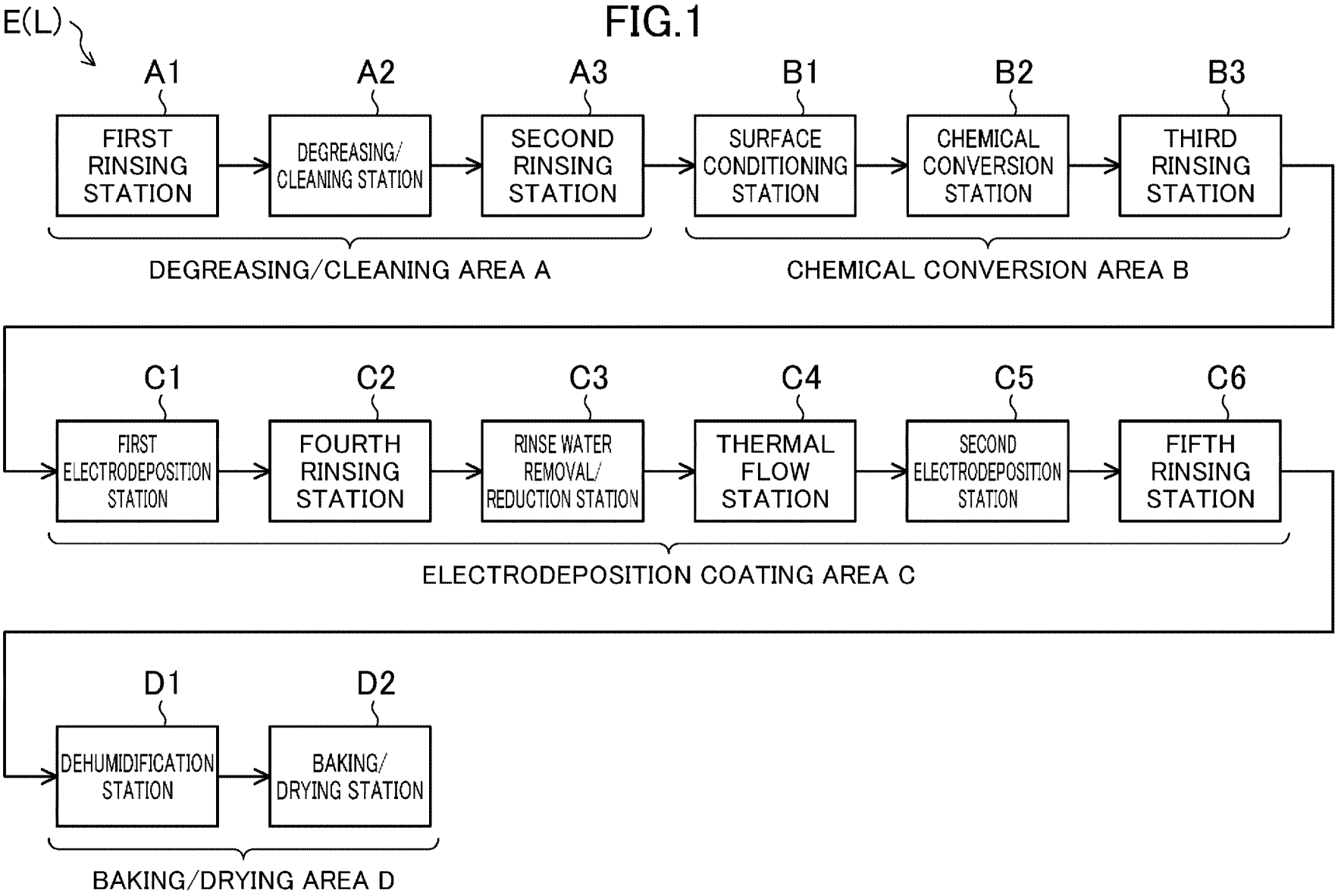
FIG. 1 illustrates a process flow of an electrodeposition coating method according to an exemplary embodiment.

FIG. 1 illustrates a process flow of an electrodeposition coating method according to the exemplary embodiment. In the present embodiment, a target object to be coated by an electrodeposition coating apparatus E is an automotive body 1 (see FIG. 2 and other drawings). The electrodeposition coating apparatus E includes an electrodeposition coating line L. The electrodeposition coating line L includes, in the order from the upstream side, a degreasing/cleaning area A (degreasing/cleaning device), a chemical conversion area B (chemical conversion device), an electrodeposition coating area C (electrodeposition coating layer formation device), and a baking/drying area D. The automotive body 1 is transported by a hanger-type conveyor which will be described later. Specifically, the automotive body 1, carried by a hanger 45 (see FIGS. 5, 6, 8, 9, and 12), is sent to the areas A, B, C, and D in this order.

<Degreasing/Cleaning Area A>

In the degreasing/cleaning area A, a degreasing/cleaning step of removing dirt or an oil and fat content on a surface of the automotive body 1 is performed. As shown in FIG. 1, in the degreasing/cleaning area A, a first rinsing station A1, a degreasing/cleaning station A2, and a second rinsing station A3 are arranged in this order from the upstream side of the electrodeposition coating line L.

In the first rinsing station A1, the automotive body 1, from the surface of which the dirt or the oil and fat content has not been removed yet, is rinsed with water. To this end, the first rinsing station A1 is provided with a dipping tank or a spray nozzle. The automotive body 1 is rinsed through immersion in rinse water stored in the dipping tank or spraying of the rinse water thereon using the spray nozzle. The rinse water in the dipping tank or discharged from the spray nozzle has a temperature of 40° C. to 50° C. Thus, rinsing with water at a temperature higher than room temperatures easily removes the oil and fat content adhering to the surface of the automotive body 1.

Figure 2:
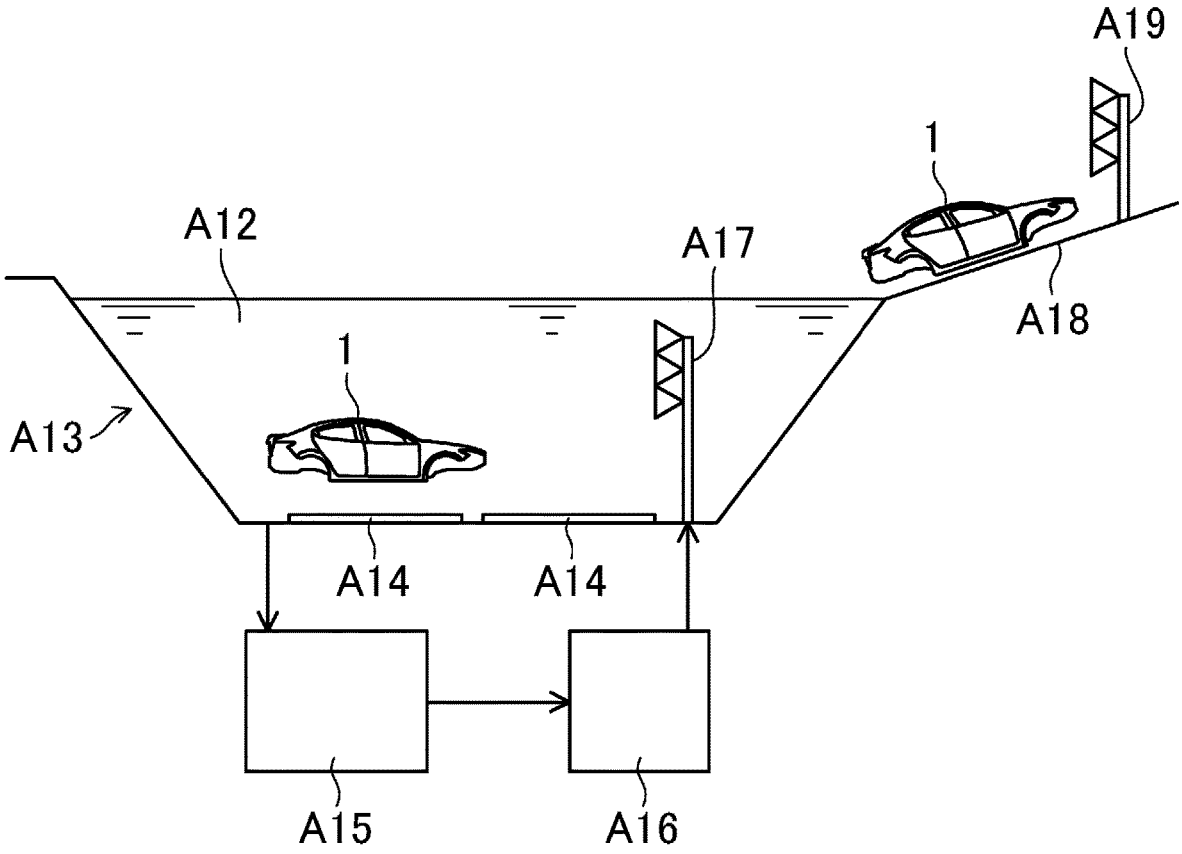
FIG. 2 is a cross-sectional view schematically illustrating a degreasing bath provided for an electrodeposition coating apparatus.

As shown in FIG. 2, the degreasing/cleaning station A2 is provided with a degreasing tank A13 storing a degreasing solution A12 in which the automotive body 1 that has been rinsed in the first rinsing station A1 is immersed. A plurality of ultrasonic vibrators A14 are arranged on a wall portion (in the present embodiment, a bottom wall portion) of the degreasing tank A13. The ultrasonic vibrators A14 generate ultrasonic vibration, which causes the degreasing solution A12 to vibrate. Then, an infinite number of small bubbles are generated in the degreasing solution A12, and collide with the automotive body 1 to break. Shock waves produced at this moment remove the dirt or the oil and fat content adhering to the surface of the automotive body 1, thereby degreasing and cleaning the automotive body 1. The degreasing solution A12 in the degreasing tank A13 has a temperature of 40° C. to 50° C. The degreasing/cleaning treatment using the ultrasonic vibrators A14 is performed for about one minute to two minutes. This cleans the dirt or the oil and fat content away from 90% or more of the whole area of the automotive body 1. In the present embodiment, the degreasing tank A13 and the ultrasonic vibrators A14 constitute a degreasing device.

As the degreasing solution A12, a filtrate obtained through a filtration device A15 of the degreasing tank A13 is used. Therefore, in the degreasing tank A13, the filtration device A15, a pump A16, and the spray nozzle A17 are connected in this order from the upstream side, and the spray nozzle A17 is arranged in the degreasing tank A13. In the filtration device A15, the degreasing solution A12 is centrifuged, and is allowed to pass through a filter so that the oil and fat content and iron powder are removed from the solution. That is, in order to reduce the waste of the degreasing solution A12, the degreasing solution A12 used for the degreasing/cleaning passes through the filtration device A15 to remove the oil content and the iron powder from the solution, and the pump A16 supplies the filtrate from which the oil content and the like have been removed to the degreasing tank A13 via the spray nozzle A17.

On the downstream side of the degreasing tank A13, an inclined portion A18 is provided for further removal of the oil content and the iron powder remaining on the automotive body 1 that has been degreased and cleaned in the degreasing tank A13. The inclined portion A18 is inclined upward from the upstream side toward the downstream side. Spray nozzles A19 are arranged on the left and right sides of the automotive body 1 on the inclined portion A18. The spray nozzles A19 spray the degreasing solution A12 on the automotive body 1. Although the automotive body 1 is immersed in the degreasing solution together with the hanger 45, FIG. 2 does not show the hanger-type conveyor.

In the second rinsing station A3, just like in a fifth rinsing station C6 which will be described later, the automotive body 1 that has been degreased and cleaned in the degreasing/cleaning station A2 is successively rinsed through dipping, spraying, dipping, and spraying. For this purpose, a first dipping tank, a first spray nozzle, a second dipping tank and a second spray nozzle are provided.

<Chemical Conversion Area B>

In the chemical conversion area B, a chemical conversion step of forming a chemical conversion layer on the surface of the automotive body 1 from which the dirt or the oil and fat content has been removed is performed. In the chemical conversion area B, a surface conditioning station B1, a chemical conversion station B2, and a third rinsing station B3 are arranged in this order from the upstream side of the electrodeposition coating line L.

In the surface conditioning station B1, the surface conditioning is performed for the subsequent chemical conversion in the chemical conversion station B2. The surface conditioning of the automotive body 1 can make crystals dense, improve corrosion resistance, and shorten chemical conversion time. The surface conditioning station B1 is provided with a surface conditioning tank storing a surface conditioning solution in which the automotive body 1, from which the dirt or the oil and fat content has been removed through the degreasing/cleaning, is immersed.

In the chemical conversion station B2, a chemical conversion layer is formed on the surface of the automotive body 1 whose surface has been conditioned. The chemical conversion station B2 includes a chemical conversion tank which stores a chemical conversion solution in which the automotive body 1 whose surface has been conditioned is immersed. The chemical conversion tank stores a treatment liquid containing zinc phosphate as the chemical conversion solution. The chemical conversion solution has a temperature of about 40° C. The treatment time from the immersion of the automotive body 1 in the chemical conversion tank to the formation of the chemical conversion layer is about two minutes to three minutes. This chemical conversion forms a chemical conversion layer of about 2 μm on the surface of the automotive body 1.

In the chemical conversion tank, a filtration device, a pump, and a spray nozzle are connected in this order from the upstream side, and the spray nozzle is provided in the chemical conversion tank. The filtration device, the pump, and the spray nozzle are connected in the same manner as the filtration device A15, the pump A16, and the spray nozzle A17 connected to the degreasing tank A13 (see FIG.

2), and thus, the illustration thereof is omitted. In the filtration device, chemical conversion sludge in the chemical conversion solution is removed through precipitating the sludge by gravity, or centrifuging the chemical conversion solution, and further allowing the solution to pass through a filter. That is, in order to efficiently utilize the chemical conversion solution, the chemical conversion solution that has been used for the chemical conversion is allowed to pass through the filtration device to remove the chemical conversion sludge, and the filtrate from which the chemical conversion sludge has been removed is supplied by the pump to the chemical conversion tank via the spray nozzle.

In the third rinsing station B3, the automotive body 1 on which the chemical conversion layer has been formed is successively rinsed through spraying and subsequent dipping. To this end, the third rinsing station B3 is provided with a spray nozzle and a dipping tank. The automotive body 1 is cleaned by the rinse water sprayed thereon by the spray nozzle, and then cleaned through immersion in the rinse water stored in the dipping tank.

<Electrodeposition Coating Area C>

In the electrodeposition coating area C, an electrodeposition coating layer formation step is performed, i.e., an electrodeposition coating layer including a first electrodeposition coating film and a second electrodeposition coating film stacked on the first electrodeposition coating film is formed on the surface of the automotive body 1 on which the chemical conversion layer has been formed. In the electrodeposition coating area C illustrated in FIGS. 1 and 3, a first electrodeposition station C1, a fourth rinsing station C2, a rinse water removal station C3, a thermal flow station C4, a second electrodeposition station C5, and a fifth rinsing station C6 are arranged in this order from the upstream side of the electrodeposition coating line L.

Figure 4:
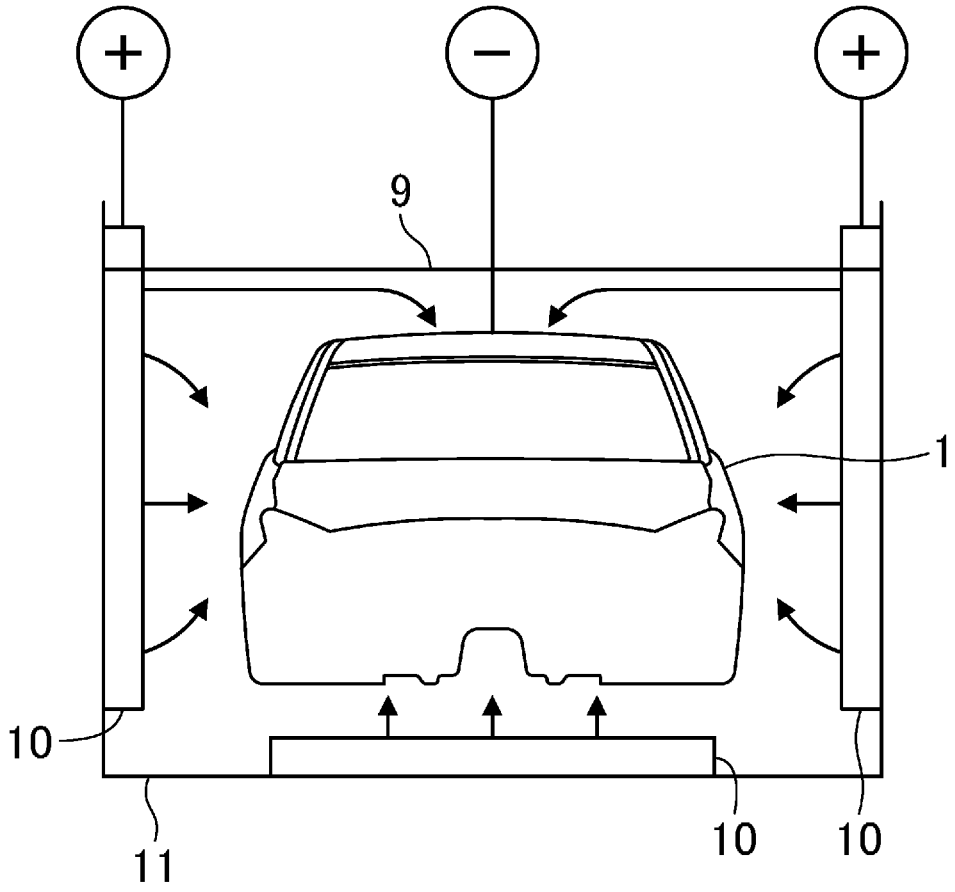
FIG. 4 is a cross-sectional view schematically illustrating a first electrodeposition tank provided for the electrodeposition coating apparatus.

As shown in FIG. 4, the first electrodeposition station C1 is provided with a first electrodeposition tank 11 storing electrodeposition paint 9 in which the automotive body 1 that has gone through the chemical conversion is immersed. In the first electrodeposition station C1, cationic electrodeposition coating is performed using the automotive body 1 immersed in the first electrodeposition tank 11 as a cathode, and first counter electrodes 10 provided on the right, left, and lower sides of the automotive body 1 in the first electrodeposition tank 11 as anodes. In this way, the first electrodeposition coating film is formed on the automotive body 1. Although the automotive body 1 is immersed in the electrodeposition paint 9 together with the hanger 45, FIG. 4 does not show the hanger-type conveyor. In the present embodiment, the first electrodeposition tank 11 that has the first counter electrodes 10 and stores the electrodeposition paint 9 constitutes a first electrodeposition device that forms the first electrodeposition coating film on the automotive body 1.

Figure 3:
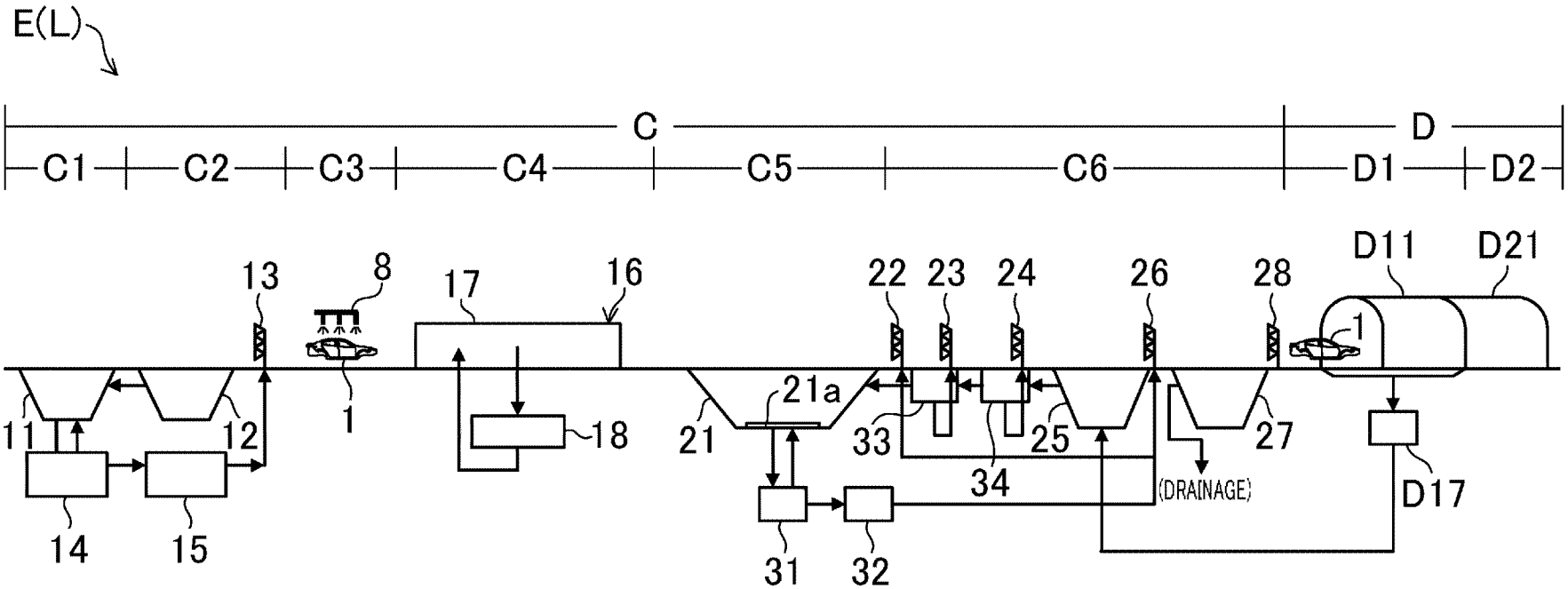
FIG. 3 is a view illustrating an electrodeposition coating area and baking/drying area of an electrodeposition coating line.

In the fourth rinsing station C2, the automotive body 1 on which the electrodeposition paint in the first electrodeposition tank 11 has been electrodeposited (the first electrodeposition coating film has been formed) is successively rinsed through dipping and subsequent spraying. To this end, the fourth rinsing station C2 is provided with a dipping tank 12 and a spray nozzle 13 as shown in FIG. 3. The automotive body 1 is cleaned through immersion in the rinse water stored in the dipping tank 12, and then cleaned by the rinse water sprayed thereon by the spray nozzle 13. In the present embodiment, the dipping tank 12 and the spray nozzle 13 constitute a first rinsing device that rinses, with the rinse water, the automotive body 1 on which the first electrodeposition coating film has been formed.

The rinse water used for the dip-rinsing and the spray-rinsing in the fourth rinsing station C2 is a UF filtrate obtained through ultrafiltration (which will be hereinafter sometimes referred to as "UF") of the electrodeposition paint 9 in the first electrodeposition tank 11. To this end, a UF device 14 for recovering the electrodeposition paint 9 from the solution in the first electrodeposition tank 11 and a filtrate tank 15 for storing the UF filtrate obtained in the UF device 14 are provided. The electrodeposition paint 9 recovered by the UF device 14 is returned to the first electrodeposition tank 11. The UF filtrate in the filtrate tank 15 is supplied to the spray nozzle 13; a rinse liquid (rinse water) that has been sprayed from the spray nozzle 13 is recovered to the dipping tank 12; and an overflow from the dipping tank 12 is recovered to the first electrodeposition tank 11.

In the rinse water removal station C3, the rinse water on a roof 1*a* (see FIGS. 5 to 9), which is substantially horizontal, and thus, serves as a rinse water stagnating surface that stagnates the rinse water thereon, of the automotive body 1, is forcibly removed or reduced without heating. In order to remove or reduce the rinse water, the rinse water removal station C3 is provided with a rinse water removal accelerator 8 (corresponding to a rinse water removal/reduction device). The rinse water removal station C3 will be described later in detail.

In the thermal flow station C4, the first electrodeposition coating film is allowed to thermally flow so that the first electrodeposition coating film formed on a portion of the automotive body 1 near the first counter electrodes 10 (e.g., an outer plate portion and outer surface of the automotive body 1) in the formation of the first electrodeposition film has a higher electrical resistance than the first electrodeposition coating film formed on a portion of the automotive body 1 far from the first counter electrodes 10 (e.g., an inner plate portion and inner surface of the automotive body 1). To this end, the thermal flow station C4 is provided with a coating thermal flow device 16 (corresponding to a thermal flow device) as shown in FIG. 3. The coating thermal flow device 16 includes a warm air heating furnace 17 to which warm air from a heater 18 is supplied. While the automotive body 1 passes through the warm air heating furnace 17, the first electrodeposition coating film is allowed to thermally flow. The specific configuration of the coating thermal flow device 16 will be described later in detail.

The second electrodeposition station C5 is provided with a second electrodeposition tank 21 which is similar to the first electrodeposition tank 11 and stores electrodeposition paint in which the automotive body 1 that has passed through the thermal flow station C4 is immersed. In the second electrodeposition station C5, just like in the first electrodeposition station C1, cationic electrodeposition coating is performed using the automotive body 1 immersed in the second electrodeposition tank 21 as a cathode, and second counter electrodes 21*a* provided in the second electrodeposition tank 21 (provided on the right, left, and lower sides of the automotive body 1 just like the first counter electrodes 10, but only the lower second counter electrode 21*a* is shown in FIG. 3) as anodes. In the present embodiment, the components of the electrodeposition paint in the second electrodeposition tank 21 are the same as those of the electrodeposition paint 9 in the first electrodeposition tank 11, but may be different from the components of the electrodeposition paint 9. In this way, the second electrodeposition coating film is formed on the automotive body 1. In the present embodiment, the second electrodeposition tank 21 that has the second counter electrodes 21*a* and stores the electrodeposition paint constitutes a second electrodeposition device that forms the second electrodeposition coating film on the automotive body 1.

In the fifth rinsing station C6, the automotive body 1 on which the electrodeposition paint in the second electrodeposition tank 21 has been electrodeposited (the second electrodeposition coating film has been formed) is successively rinsed through spraying, dipping, spraying, dipping, and spraying. To this end, first to third spray nozzles 22 to 24, a first dipping tank 25, a fourth spray nozzle 26, a second dipping tank 27, and a fifth spray nozzle 28 are provided in this order from the upstream side of the electrodeposition coating line L. In the present embodiment, the first to third spray nozzles 22 to 24, the first dipping tank 25, the fourth spray nozzle 26, the second dipping tank 27, and the fifth spray nozzle 28 constitute a second rinsing device that rinses, with the rinse water, the automotive body 1 on which the second electrodeposition coating film has been formed.

The rinse water used for the spray-rinsing by the first to fourth spray nozzles 22 to 24 and 26, and for the dip-rinsing in the first dipping tank 25 is a UF filtrate obtained through ultrafiltration of the electrodeposition paint in the second electrodeposition tank 21. To this end, a UF device 31 for recovering the electrodeposition paint from the solution in the second electrodeposition tank 21 and a filtrate tank 32 for storing the UF filtrate obtained in the UF device 31 are provided. In addition, the fifth rinsing station C6 is provided with rinse liquid recovery tanks 33, 34 that respectively recover rinse liquids sprayed from the second and third spray nozzles 23 and 24. On the other hand, industrial water is used for the dip-rinsing in the second dipping tank 27 and for the spray-rinsing by the fifth spray nozzle 28.

The electrodeposition paint recovered by the UF device 31 is returned to the second electrodeposition tank 21. The UF filtrate in the filtrate tank 32 is supplied to the first and fourth spray nozzles 22, 26. The rinse liquid (rinse water) sprayed from the fourth spray nozzle 26 is recovered to the first dipping tank 25. An overflow from the first dipping tank 25 is recovered to the rinse liquid recovery tank 34 for the third spray nozzle 24. The rinse liquid in the rinse liquid recovery tank 34 is supplied to the third spray nozzle 24, and an overflow from the rinse liquid recovery tank 34 is recovered to the rinse liquid recovery tank 33 for the second spray nozzle 23. The rinse liquid in the rinse liquid recovery tank 33 is supplied to the second spray nozzle 23, and an overflow from the rinse liquid recovery tank 33 is recovered to the second electrodeposition tank 21.

<Rinse Water Removal Station C3>

Figure 5:
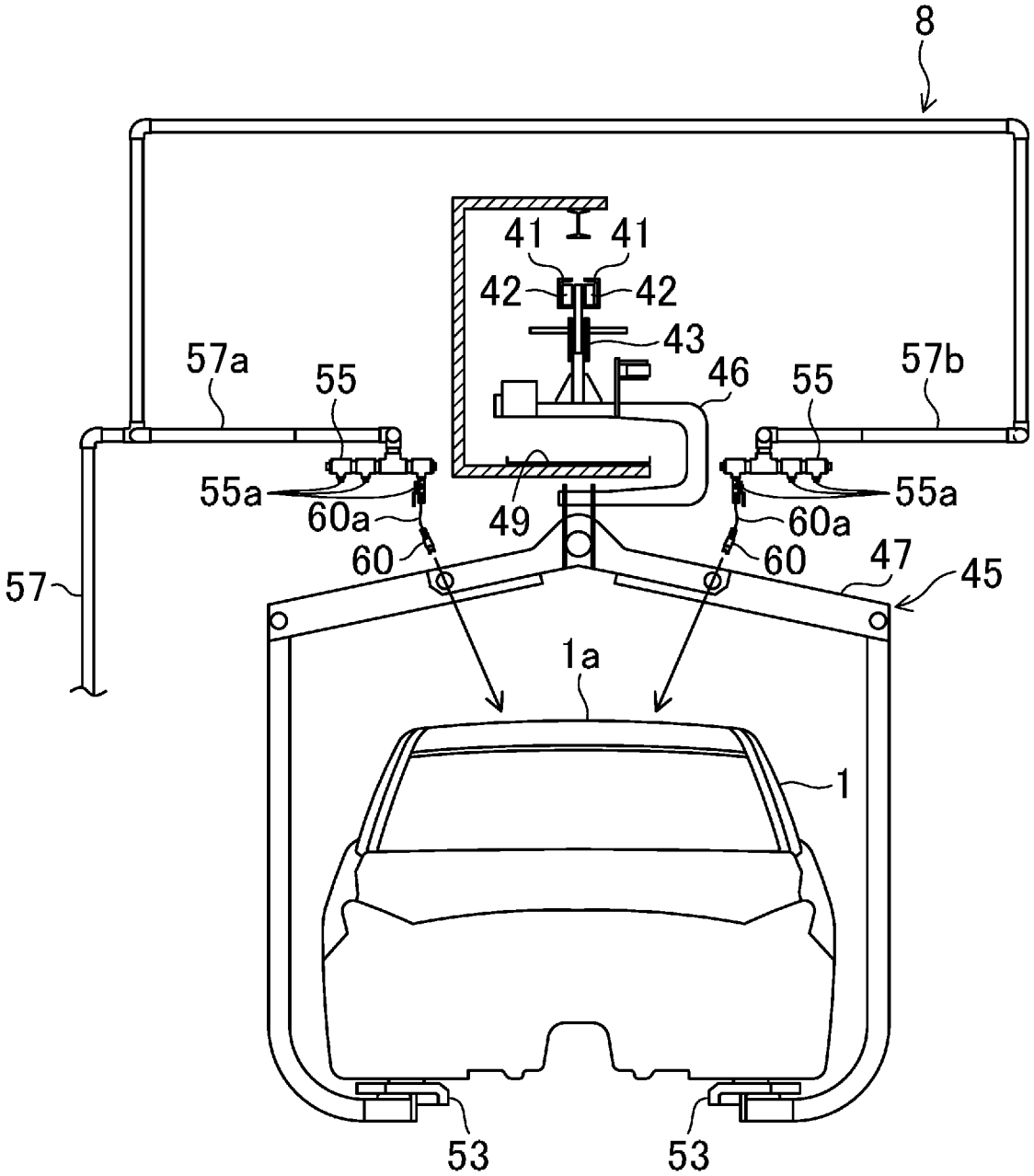
FIG. 5 is a front view, partially in section, illustrating a rinse water removal accelerator (air blower) provided for the electrodeposition coating apparatus.
Figure 6:
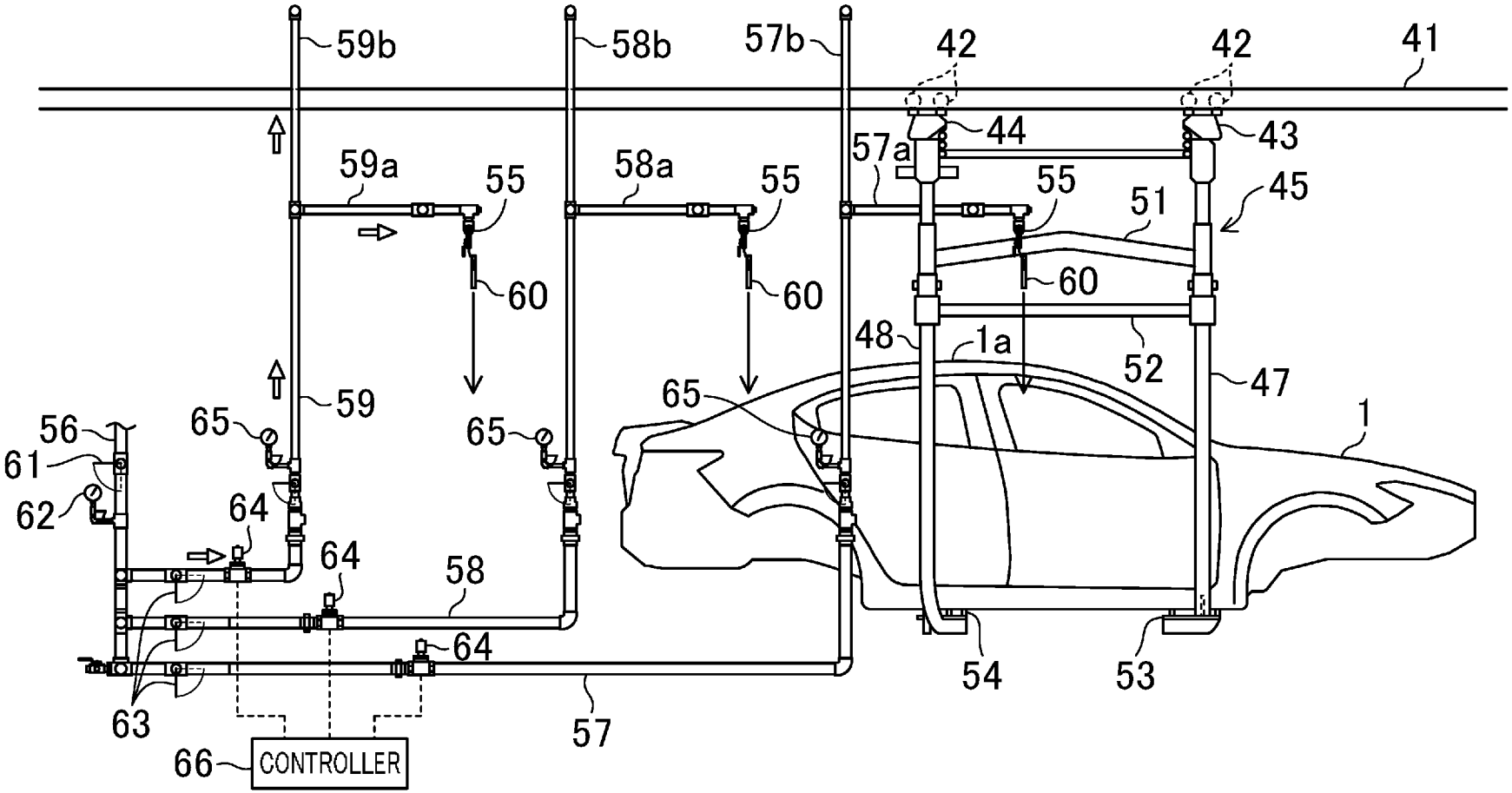
FIG. 6 is a side view of the rinse water removal accelerator.

The automotive body 1 is transported by an overhead conveyor (hanger-type conveyor) along the electrodeposition coating line L in the entire electrodeposition coating device E including the rinse water removal station C3. As simply illustrated in FIGS. 5 and 6, the hanger-type conveyor includes a guide rail 41 extending along the electrodeposition coating line L, front and rear trolleys 43, 44 that engage with the guide rail 41 via rollers 42 and move along the guide rail 41, and a hanger 45 suspended by the trolleys 43, 44 and carries the automotive body 1. In FIG. 5, a reference numeral 49 denotes an oil pan.

The hanger 45 includes front and rear gate-shaped frames 47, 48 that are respectively suspended from the front and rear trolleys 43, 44 via C-necks 46 to support the automotive body 1 from the left and right sides. The front and rear gate-shaped frames 47, 48 are connected to each other by two connecting bars 51, 52. The front and rear gate-shaped frames 47, 48 respectively include, at their lower end portions, receiving portions 53, 54 for receiving the automotive body 1.

Figure 7:
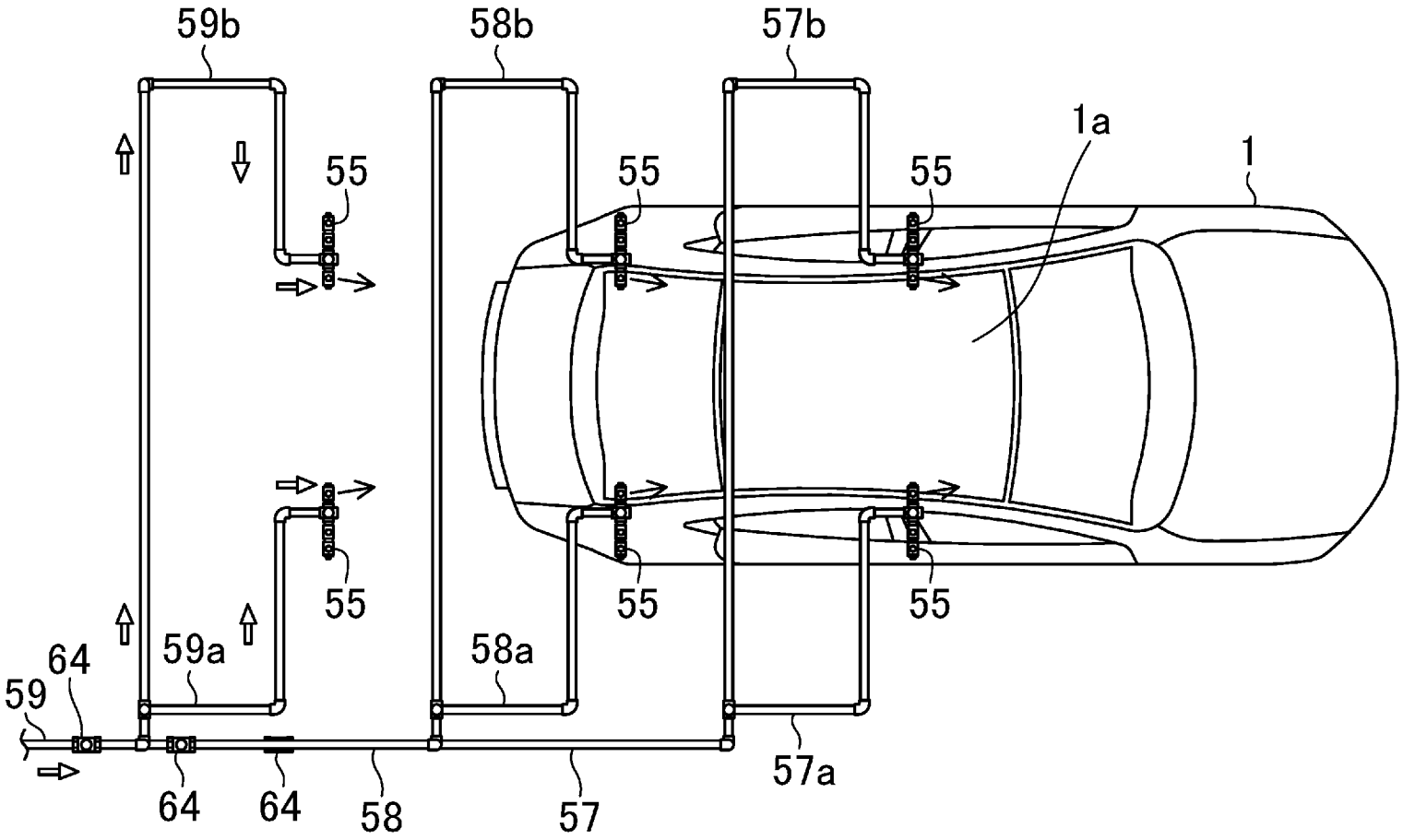
FIG. 7 is a plan view of the rinse water removal accelerator.

In the present embodiment, the rinse water removal accelerator 8 of the rinse water removal station C3 is configured as an air blower that blows the air as a gas toward the roof 1*a*. As shown in FIG. 7, the air blower includes three pairs of nozzle mounting tubes 55 (six nozzle mounting tubes in total). That is, the three pairs of nozzle mounting tubes 55 are arranged at intervals, i.e., one on the front side, one in the middle, and one on the rear side, in the transport direction of the automotive body 1, and each pair of nozzle mounting tubes 55 includes left and right nozzle mounting tubes 55 arranged at intervals in a horizontal direction perpendicular to the transport direction. Nozzles (blow nozzles) 60 (see FIGS. 5 and 6) attached to the left and right nozzle mounting tubes 55 of each pair are respectively responsible for the removal of the rinse water remaining on the left and right portions of the roof 1*a*.

The nozzle mounting tubes 55 are arranged above an automotive body transport path which the automotive body 1 mounted on the receiving portions 53, 54 of the hanger 45 passes. Each nozzle mounting tube 55 includes three nozzle mounts 55*a*, and in the present embodiment, the nozzle 60 is attached to one of the nozzle mounts 55*a* via a copper pipe 60*a* as illustrated in FIG. 5. Each nozzle 60 has an air outlet that opens downward to blow the air to the roof 1*a* of the automotive body 1. In the present embodiment, as indicated by arrows in FIGS. 5 and 6, the air from the nozzles 60 is blown toward the roof 1*a* from the vertical position above the gate-shaped frames 47, 48 of the hanger 45. The air is blown to the roof 1*a* at a speed of approximately 20 m/sec to 25 m/sec. The blowing speed is a flow velocity of the air at a position where the roof 1*a* of the automotive body 1 is assumed to exist when the air is blown from the nozzle 60 in the absence of the automotive body 1 below the nozzle 60.

Next, an air pipe that supplies the air to the nozzle 60 will be described below. From an air compressor (not shown) as an air source, a first air supply pipe 56 extends beside the automotive body transport path in the rinse water removal station C3. The first air supply pipe 56 branches into three second air supply pipes 57 to 59 to supply the air to the three pairs of nozzle mounting tubes 55. The second air supply pipes 57 to 59 branch into the third air supply pipes 57*a* and 57*b*, 58*a* and 58*b*, and 59*a* and 59*b*, respectively, to supply the air to the left and right nozzle mounting tubes 55.

The first air supply pipe 56 is provided with a manual open/close valve 61 and a pneumatic meter 62. Each of the three second air supply pipes 57 to 59 is provided with a manual open/close valve 63 that opens or closes an associated one of the pipes, an electromagnetic valve 64 that controls the air supply to the nozzles 60 and the stop of the air supply, and a pneumatic meter 65.

Further, the air blower as the rinse water removal accelerator 8 includes a controller 66 that controls the operation of the electromagnetic valve 64 in accordance with the position of the automotive body 1 being transported. This controller 66 is a controller based on a commonly known microcomputer, and includes a central processing unit (CPU) which executes computer programs (including basic control programs such as OSes, and application programs which run on an OS and implement particular functions), a memory which is configured as, for example, a RAM or a ROM, and stores the computer programs and data, and an input/output (I/O) bus which inputs and outputs electrical signals. To control the operation of the electromagnetic valve 64, an optical sensor (not shown) is provided to detect whether or not the roof 1*a* of the automotive body 1 is located in front of the air outlet of the nozzle 60 (or below the air outlet because the air outlet faces downward). The optical sensor transmits a detection signal to the controller 66. The controller 66 controls the operation of the electromagnetic valve 64 such that the air is supplied to the nozzle 60 while the roof 1*a* of the automotive body 1 is located in front of (below) the air outlet of the nozzle 60, and controls the operation of the electromagnetic valve 64 such that the supply of the air is stopped after the roof 1*a* has passed the front of (below) the air outlet of the nozzle 60. Note that, in the present embodiment, the operation of the electromagnetic valve 64 is controlled so that the supply of the air is stopped while the gate-shaped frames 47, 48 of the hanger 45 are passing the front of (below) the air outlet of the nozzle 60.

<Coating Thermal Flow Device 16>

Figure 8:
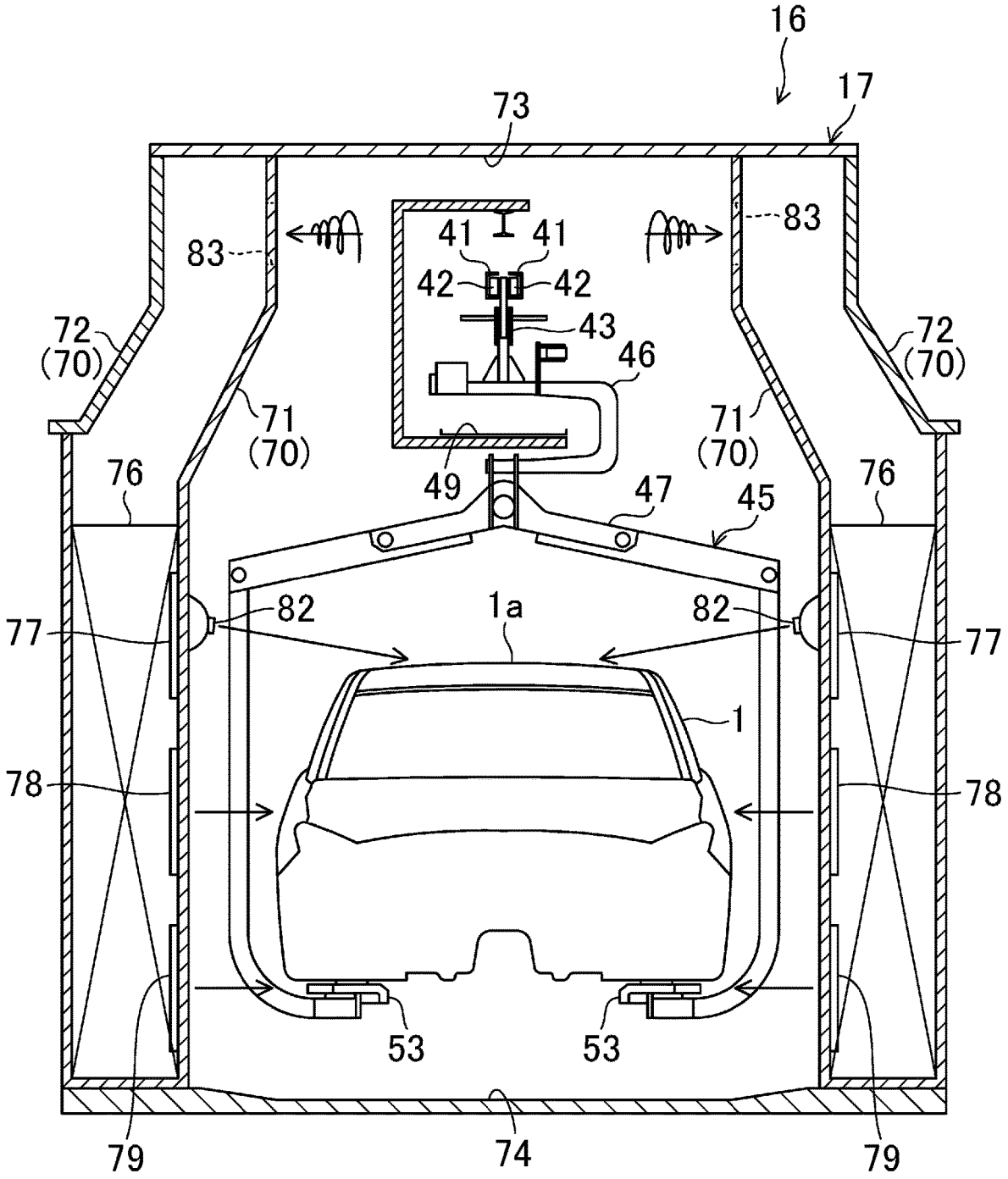
FIG. 8 is a transverse cross-sectional view illustrating a coating thermal flow device provided for the electrodeposition coating apparatus.

As shown in FIG. 8, the warm air heating furnace 17 of the coating thermal flow device 16 provided in the thermal flow station C4 has left and right sidewalls 70 facing each other, and each of the left and right sidewalls 70 has a double-wall structure including an inner wall 71 and an outer wall 72. The inner walls 71 of the left and right sidewalls 70, a ceiling wall 73, and a bottom wall 74 form a tunnel furnace extending along the electrodeposition coating line L, and the guide rail 41 of the hanger-type conveyor passes an upper portion of the tunnel furnace in a longitudinal direction of the tunnel furnace. The automotive body 1, being carried by the hanger 45, passes through the tunnel furnace.

A warm air blower 76 including a heater, a blower motor, and a blower fan is provided between the inner wall 71 and outer wall 72 of each of the left and right sidewalls 70 of the tunnel furnace. Further, upper, middle, and lower nozzle boxes 77, 78, 79 are provided on the inner wall 71 of each of the left and right sidewalls 70 for blowing warm air toward the automotive body 1 carried by the hanger 45.

Figure 9:
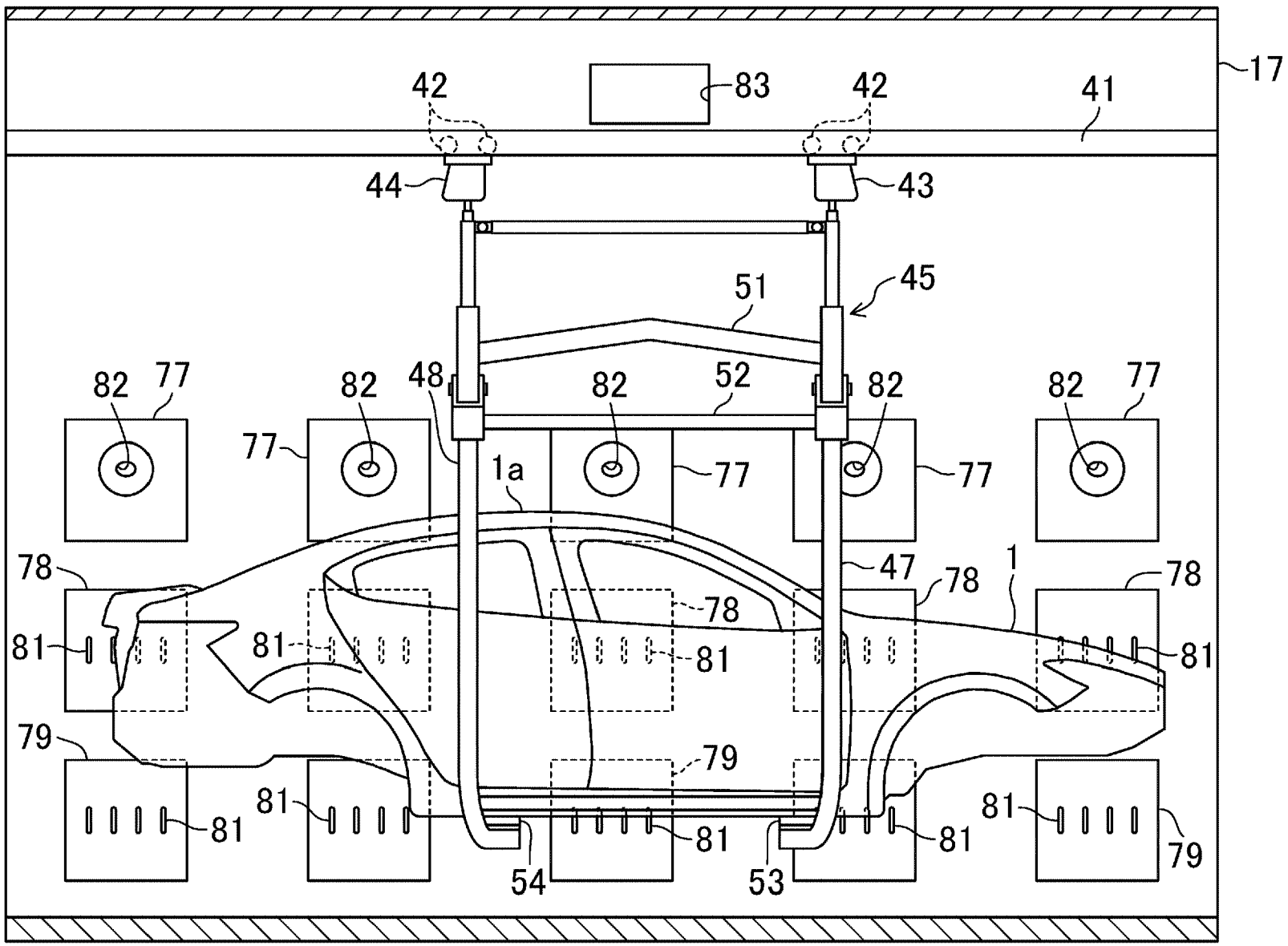
FIG. 9 is a vertical cross-sectional view illustrating the coating thermal flow device.

As shown in FIG. 9, each of the middle and lower nozzle boxes 78, 79 on the inner walls 71 is provided with a plurality of vertically-elongated slot-shaped first warm air outlets 81 which are arranged at intervals in the longitudinal direction of the tunnel furnace and from which the warm air is blown toward the side surface of the automotive body 1. Each of the upper nozzle boxes 77 on the inner walls 71 has a second warm air outlet 82 in the shape of a cylindrical hole that is oriented, and blows warm air, toward the roof 1*a*, which is a rinse water stagnating surface, of the automotive body 1.

Here, the distance from the second warm air outlets 82 to the roof 1*a* is longer than the distance from the first warm air outlets 81 to the side surface of the automotive body 1. Therefore, a speed at which the warm air is blown from each of the first and second warm air outlets 81 and 82 is set to satisfy the condition that the warm air blows faster from the second warm air outlets 82 than from the first warm air outlets 81. Accordingly, the warm air from the second warm air outlets 82 reliably reaches the roof 1*a*. The speed at which the warm air is blown to the side surface and roof 1*a* of the automotive body 1 from each of the first warm air outlets 81 and the second warm air outlets 82 is approximately 5 m/sec to 15 m/sec (as long as the above condition is satisfied). In addition, each second warm air outlet 82 is formed in the shape of a cylindrical hole so that the warm air from the second warm air outlets 82 is reliably oriented to the roof.

An air inlet 83 is opened in an upper portion of each inner wall 71 to suck the air heated in the tunnel furnace and cause the heated air to circulate to the warm air blower 76.

<Baking/Drying Area D>

In the baking/drying area D, an electrodeposition coating layer curing step is performed, i.e., the rinse water remaining on the surface of the automotive body 1 that has been rinsed after the formation of the electrodeposition coating layer is removed, and the surface of the automotive body 1 is heated to cure the electrodeposition coating layer. In the baking/drying area D, a dehumidification station D1 and a baking/drying station D2 are arranged in this order from the upstream side of the electrodeposition coating line L.

The dehumidification station D1 is provided with a dehumidifier M (see FIGS. 10 and 11) that dries the rinse water on the surface of the automotive body 1 rinsed with water in the fifth rinsing station C6 after the formation of the electrodeposition coating layer. The dehumidifier M has a dehumidification furnace D11 (see FIGS. 3 and 10 to 12) to which the automotive body 1 is sent. In the dehumidification furnace D11, the humidity in the dehumidification furnace D11 is lowered using a heat pump D13 provided outside the dehumidification furnace D11, while allowing the rinse water adhering to the automotive body 1 sent thereto to fall in drops by gravity, so as to dry the rinse water on the surface of the automotive body 1. The specific configuration of the dehumidification furnace D11 will be described later in detail.

Figure 10:
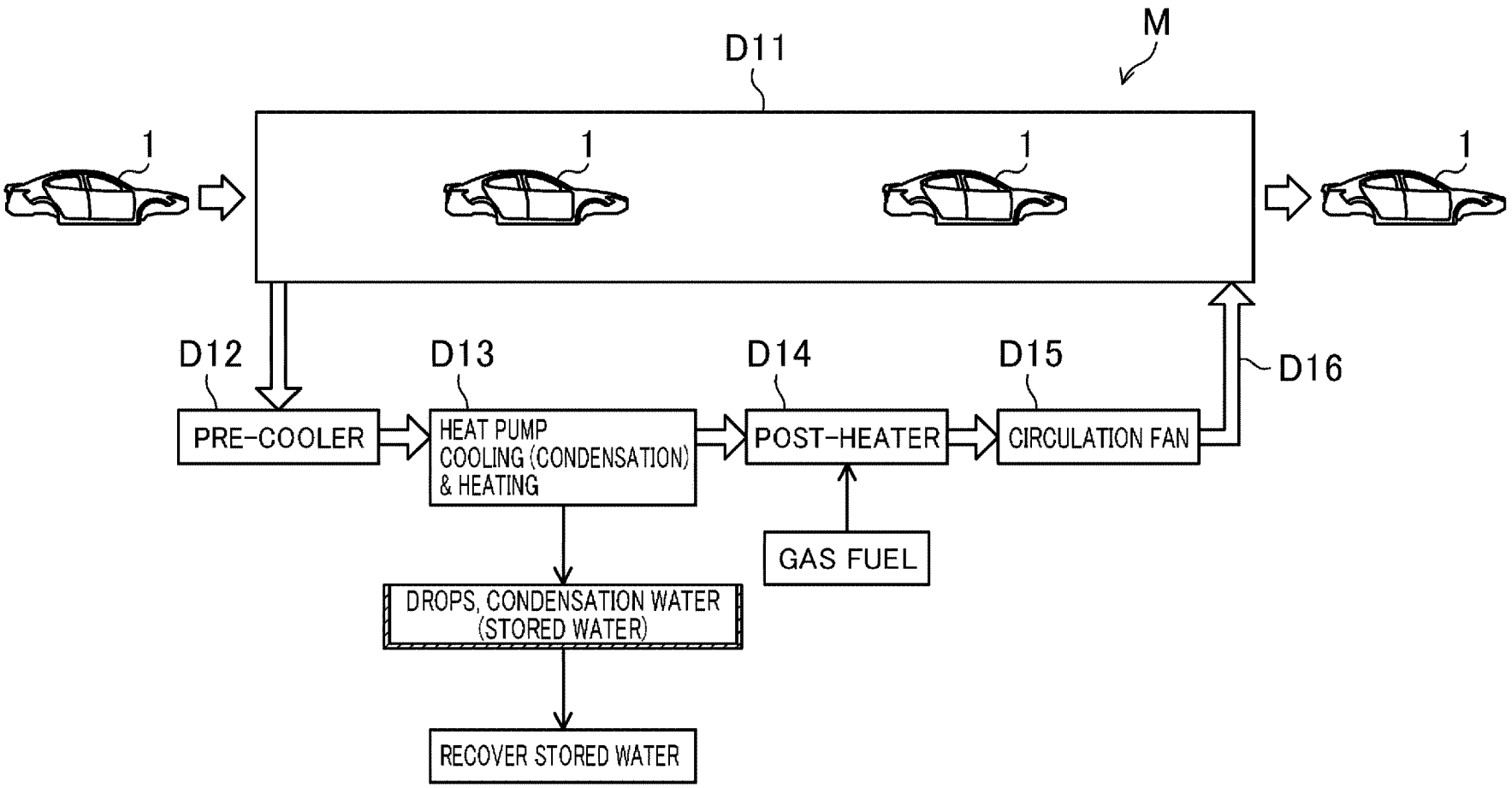
FIG. 10 is a block diagram illustrating a dehumidifier provided for the electrodeposition coating apparatus.

The dehumidifier M takes out the air in the dehumidification furnace D11 (in particular, an upstream portion of the air which has entered the dehumidification furnace D11 from the outside of the dehumidification furnace D11 together with the automotive body 1), lowers the humidity of the air, and returns the air that has its humidity lowered to the dehumidification furnace D11. Specifically, as shown in FIG. 10, the dehumidifier further includes a pre-cooler D12 for cooling the air taken out from the dehumidification furnace D11, a heat pump D13 (a cooler 93 and a heater 94) for further cooling, and then heating, the air taken out from the pre-cooler D12, a post-heater D14 for heating the air heated by the heat pump D13, and a circulation fan D15. The dehumidification furnace D11, the pre-cooler D12, the heat pump D13, the post-heater D14, and the circulation fan D15 are connected by a circulation path D16 that returns the air taken out from the dehumidification furnace D11 to the dehumidification furnace D11 after passing through the pre-cooler D12, the heat pump D13, the post-heater D14, and the circulation fan D15 in this order. The pre-cooler D12, the heat pump D13, the post-heater D14, the circulation fan D15, and the circulation path D16 constitute a temperature/humidity control system that controls the temperature and humidity in the dehumidification furnace D11. Details of the temperature/humidity control system will be described later.

In the baking/drying station D2, a baking/drying furnace D21 (see FIG. 3) is provided, to which the automotive body 1 that has gone through the removal of the rinse water adhering to the surface in the dehumidification furnace D11 is sent. In the baking/drying station D2, the electrodeposition coating layer formed on the surface of the automotive body 1 is cured and dried. The baking/drying furnace D21 is connected to the dehumidification furnace D11.

<Temperature/Humidity Control System of Dehumidifier M>

Figure 11:
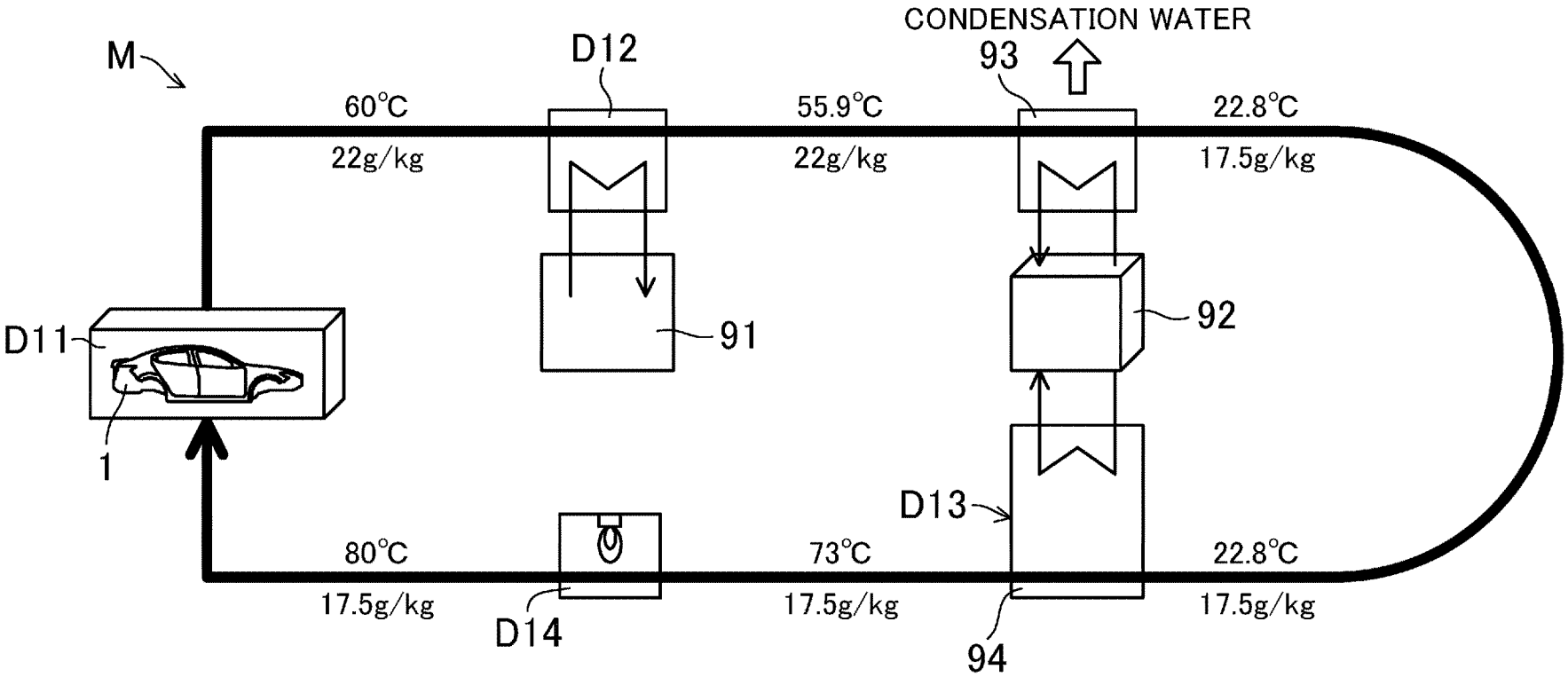
FIG. 11 is a view illustrating a temperature/humidity control system of the dehumidifier provided for the electrodeposition coating apparatus.

In the pre-cooler D12, as shown in FIG. 11, the air introduced from the dehumidification furnace D11 is cooled through heat exchange with cold water obtained in an outdoor cooling tower 91. This pre-cooler D12 controls the temperature of the air introduced from the dehumidification furnace D11.

A cooler 93 and a heater 94 arranged downstream of the cooler 93 are provided between the pre-cooler D12 and the post-heater D14 in the circulation path D16. The cooler 93 cools the air taken out from the dehumidification furnace D11 through heat exchange with a heating medium (in the present embodiment, water) so that part of moisture in the air is condensed as condensation water. The heater 94 heats the air cooled by the cooler 93 through heat exchange with the heating medium.

The cooler 93 and the heater 94 constitute part of the heat pump D13. That is, the heat pump D13 connects the cooler 93 and the heater 94 so that the heating medium can circulate therebetween, and is configured to supply cold thermal energy for cooling the air to the cooler 93, and warm thermal energy for heating the air to the heater 94. The heating medium of the heat pump D13 is heated by the cooler 93, and is cooled by the heater 94. In other words, the heat pump D13 uses the air taken out from the dehumidification furnace D11 as a heat absorption source, and the air cooled through heat absorption as a heat radiation source. In this way, the air taken out from the dehumidification furnace D11 is cooled and heated using the heat pump D13.

As shown in FIG. 11, the cooler 93 cools the air supplied from the pre-cooler D12 through heat exchange with the heating medium (cold thermal energy) cooled by the heater 94 and supplied via a tank 92. The condensation water generated through the cooling of the air is stored in a reservoir 96*a* (see FIG. 12) provided in the dehumidification furnace D11 together with the drops fallen from the automotive body 1. Further, the heater 94 heats the air supplied from the cooler 93 through heat exchange with the heating medium (warm thermal energy) heated by the cooler 93 and supplied via the tank 92.

A gas burner is used as the post-heater D14, and a gas fuel and the outside air are supplied to the post-heater D14. This post-heater D14 is used as necessary, for example, for quick temperature rise of the air in the dehumidification furnace D11 at the start of the operation, or for control of the temperature in the dehumidification furnace D11.

With the above configuration, the air taken out from the dehumidification furnace D11 is cooled stepwise by the pre-cooler D12 and the cooler 93.

That is, the air taken out from the dehumidification furnace D11 is cooled by the pre-cooler D12 using cold thermal energy of cold water cooled by the outdoor cooling tower 91. For example, when the temperature of the air taken out from the dehumidification furnace D11 is 60° C., the pre-cooler D12 cools the air to about 55.9° C.

Then, the cooler 93 cools the air cooled by the pre-cooler D12 to, for example, about 22.8° C., which is a temperature at which the moisture in the air is condensed. When part of the moisture in the air is condensed and removed through this cooling, a weight absolute humidity of the air, which is, for example, 22 g/kg when the air is taken out from the dehumidification furnace D11, is lowered to about 17.5 g/kg.

The air cooled by the cooler 93 is heated stepwise by the heater 94 and the post-heater D14. That is, the air is heated to about 73° C. by the heater 94, heated to about 80° C. by the post-heater D14, and then returned to the dehumidification furnace D11. The air returned to the dehumidification furnace D11 has a weight absolute humidity lowered to about 17.5 g/kg through the previous cooling and condensation. That is, the dehumidification furnace D11 receives dry warm air.

In the present embodiment, the temperature in the dehumidification furnace D11 is preferably lower than 100° C. That is, the internal temperature of the dehumidification furnace D11 is controlled such that the surface temperature of the automotive body 1 sent to the dehumidification furnace D11 is lower than 100° C. If the surface temperature of the automotive body 1 is 100° C. or higher, the rinse water adhering to the surface of the automotive body 1 boils, and leaves the traces of bubbles of the rinse water generated at that time, which is not preferable. Therefore, the temperature of the air returned to the dehumidification furnace D11 is preferably lower than 100° C., more preferably 78° C. to 82° C. Further, the weight absolute humidity of the air returned to the dehumidification furnace D11 of the present embodiment is preferably less than 25 g/kg, more preferably less than 22 g/kg.

<Dehumidification Furnace D11>

Figure 12:
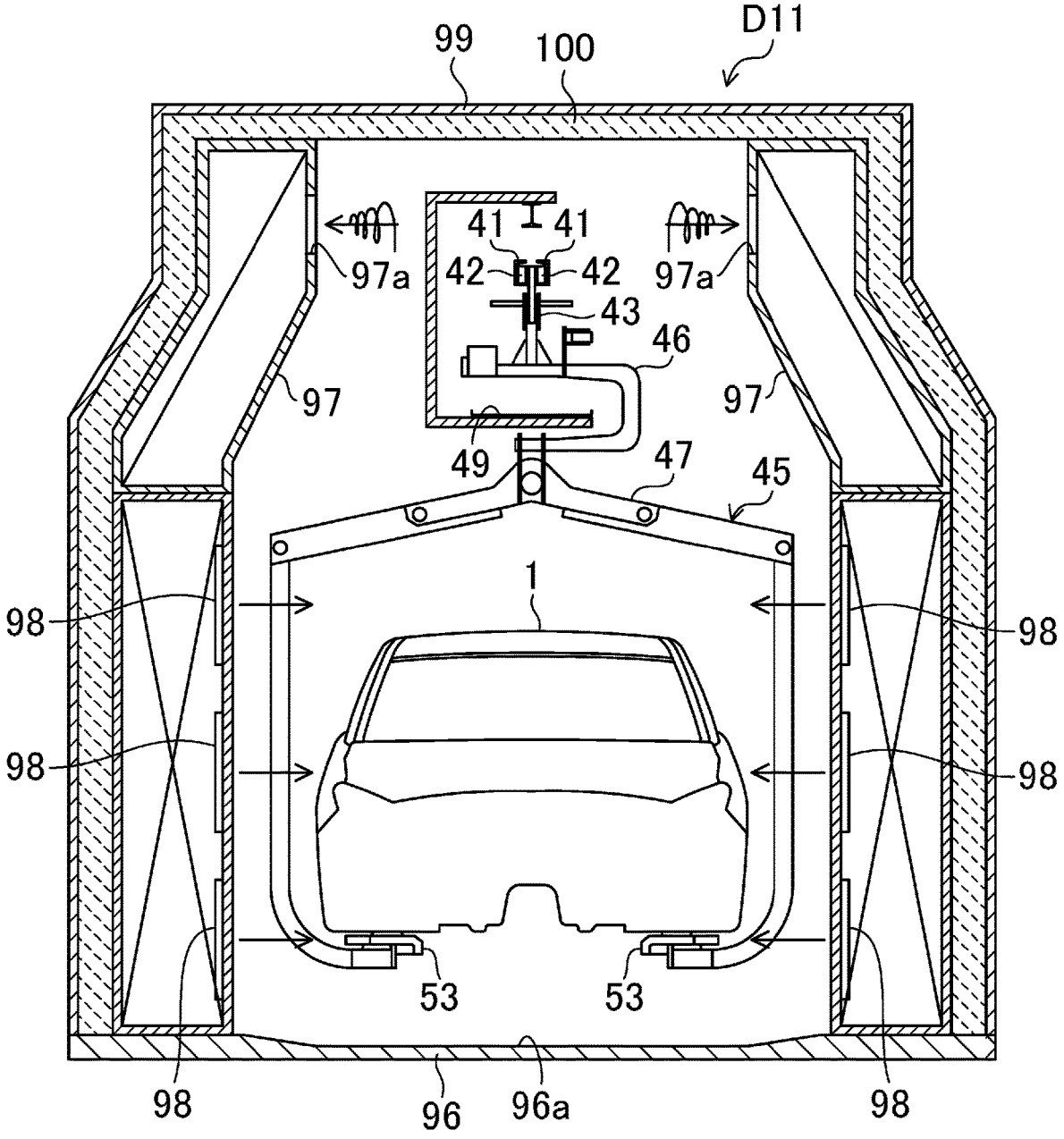
FIG. 12 is a cross-sectional view illustrating a dehumidification furnace provided for the electrodeposition coating apparatus.
Figure 13A:
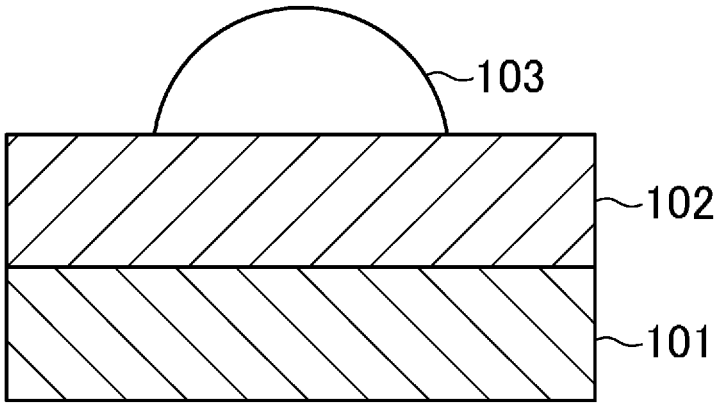
FIG. 13A is a view illustrating rinse water adhering to a first electrodeposition coating film on a target object for explaining how the electrodeposition coating film becomes uneven in a conventional double coating method.
Figure 13B:
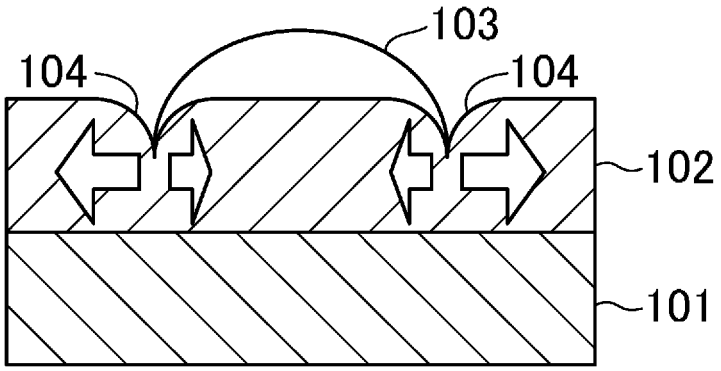
FIG. 13B is a view illustrating a state where a recess is formed when the first electrodeposition coating film of FIG. 13A is allowed to thermally flow at the boundary between a portion of the first electrodeposition coating film which gets wet with the rinse water and a dry portion to which no rinse water adheres.
Figure 13C:
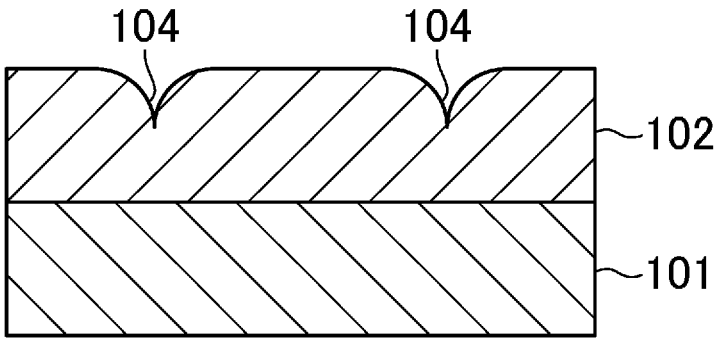
FIG. 13C is a view illustrating a state where the first electrodeposition coating film is pulled toward the dry portion at the boundary shown in FIG. 13B, forming a relatively deep recess at the boundary of the first electrodeposition coating film.
Figure 13D:
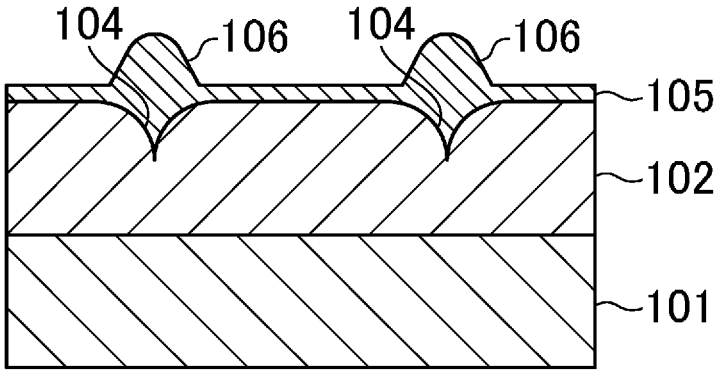
FIG. 13D is a view illustrating a state where the second electrodeposition coating is performed (a second electrodeposition coating film is formed) on the first electrodeposition coating film having the recess shown in FIG. 13C, and a projection is formed in the second electrodeposition coating film.

As shown in FIG. 12, the dehumidification furnace D11 provided in the dehumidification station D1 is formed as a tunnel furnace extending along the electrodeposition coating line L, similarly to the warm air heating furnace 17 of the coating thermal flow device 16. The dehumidification furnace D11 has left and right sidewalls facing each other, and each of the left and right sidewalls has a triple wall structure. A plurality of nozzle boxes 98 for blowing the warm air supplied from the circulation path D16 to the automotive body 1 carried by the hanger 45 is provided on inner walls 97, which are the innermost sidewalls, of the left and right sidewalls. Each nozzle box 98 is provided with a plurality of warm air outlets (not shown). An air inlet 97*a* through which the air in the dehumidification furnace D11 is discharged to the circulation path D16 is opened in an upper portion of each inner wall 97. A ceiling wall of the dehumidification furnace D11, and outer walls, which are the outermost sidewalls, of the left and right sidewalls are constituted of a wall member 99 having a substantially U-shape which is inverted to be open downward when viewed in section. A lower opening of the wall member 99 is blocked by a bottom wall 96. The reservoir 96*a*, which is in the shape of a recess, is formed in an upper surface of the bottom wall 96. An insulator 100 is provided on an inner surface of the wall member 99.

According to the above-described configuration, the electrodeposited automotive body 1, being carried by the hanger 45, is sent to the dehumidification furnace D11. In the dehumidification furnace D11, the coating film on the automotive body 1, being carried by the hanger 45, is dried. The air in the dehumidification furnace D11 (in particular, an upstream portion of the air which has entered the dehumidification furnace D11 from the outside of the dehumidification furnace D11 together with the automotive body 1) is guided from the air inlet 97*a* to the cooler 93 via the pre-cooler D12 through the operation of the circulation fan D15, and is cooled by the cooler 93.

As a result, part of the moisture in the air taken out from the dehumidification furnace D11 is condensed. The condensation water generated through the cooling of the air flows into the reservoir 96*a* of the bottom wall 96 of the dehumidification furnace D11, and is stored in the reservoir 96*a* as stored water together with the drops fallen from the automotive body 1.

The cooled air from which the moisture has been removed is guided to the heater 94, and is heated by the heater 94. The air heated by the heater 94 is further heated by the post-heater D14 as necessary, and is returned the dehumidification furnace D11 via the nozzle boxes 98 of the dehumidification furnace D11. That is, the warm air is blown into the dehumidification furnace D11 from the warm air outlets of the nozzle boxes 98.

As shown in FIG. 3, the stored water in the reservoir 96*a* passes through a filter D17 provided outside the dehumidification furnace D11 to remove dirt from the stored water, and is recovered to the first dipping tank 25 (second rinsing device). Then, the stored water is mixed with the rinse liquid (rinse water) in the first dipping tank 25, and is recovered to the rinse liquid recovery tanks 33, 34 as an overflow together with the rinse liquid. In this way, the stored water is used as the rinse water in the fifth rinsing station C6. Then, the stored water is introduced into the second electrodeposition tank 21 as the overflow from the rinse liquid recovery tanks 33, 34.

<Electrodeposition Coating Method>

In the first rinsing station A1, the automotive body 1 is immersed in, and pulled out of, the rinse water in the dipping tank to be dip-rinsed, or spray-rinsed with spray water sprayed from the spray nozzle.

Thereafter, the automotive body 1, being carried by the hanger 45, is transported from the first rinsing station A1 to the degreasing/cleaning station A2. In the degreasing/cleaning station A2, the automotive body 1 is immersed in the degreasing solution A12 in the degreasing tank A13. The ultrasonic vibrators A14 provided on the bottom wall portion of the degreasing tank A13 generate ultrasonic vibration to cause the degreasing solution A12 to vibrate, and bubbles generated through this vibration collide with the automotive body 1 to break, thereby degreasing and cleaning the automotive body 1 (degreasing step). Since the automotive body 1 is degreased and cleaned through the ultrasonic vibration, a portion of the automotive body 1 not exposed outside can also be sufficiently degreased and cleaned, as compared to the cleaning using the pressure of sprayed water.

Subsequently, the automotive body 1, being carried by the hanger 45, is transported from the degreasing/cleaning station A2 to the second rinsing station A3. In the second rinsing station A3, the automotive body 1 is immersed in, and pulled out of, the rinse water in the first dipping tank to be dip-rinsed, spray-rinsed with the rinse water sprayed from the first spray nozzle, dip-rinsed in the second dipping tank, and then spray-rinsed by the second spray nozzle.

Thereafter, the automotive body 1, being carried by the hanger 45, is transported from the second rinsing station A3 to the surface conditioning station B1. In the surface conditioning station B1, the automotive body 1 is immersed in a surface conditioning solution in the surface conditioning tank. Thus, the surface conditioning is performed for the subsequent chemical conversion in the chemical conversion station B2.

Then, the automotive body 1, being carried by the hanger 45, is transported from the surface conditioning station B1 to the chemical conversion station B2. In the chemical conversion station B2, the automotive body 1 is immersed in a chemical conversion solution in the chemical conversion tank. This forms a chemical conversion layer on the surface of the automotive body 1.

Subsequently, the automotive body 1, being carried by the hanger 45, is transported from the chemical conversion station B2 to the third rinsing station B3. In the third rinsing station B3, the automotive body 1 is immersed in, and pulled out of, the rinse water in the dipping tank to be dip-rinsed, and then spray-rinsed with the rinse water sprayed from the spray nozzle.

Subsequently, the automotive body 1, being carried by the hanger 45, is transported from the third rinsing station B3 to the first electrodeposition station C1. In the first electrodeposition station C1, as shown in FIG. 4, the automotive body 1 is immersed in the electrodeposition paint 9 in the first electrodeposition tank 11, and a direct current voltage is applied between the automotive body 1 and the first counter electrodes 10. Thus, the first electrodeposition coating film is formed on the outer plate portion and inner plate portion of the automotive body 1 (first electrodeposition step). The first electrodeposition coating film is formed thick on a portion of the automotive body 1 near the first counter electrodes 10 (a portion where the current density is high), such as the outer plate portion, and is formed thin on a portion far from the first counter electrodes 10 (a portion where the current density is low), such as the inner plate portion.

Thereafter, the automotive body 1, being carried by the hanger 45, is transported from the first electrodeposition station C1 to the fourth rinsing station C2. In the fourth rinsing station C2, the automotive body 1 is immersed in, and pulled out of, the rinse water in the dipping tank 12 to be dip-rinsed (dip-rinsing step), and then spray-rinsed (spray-rinsing step) with the rinse water sprayed from the spray nozzle 13 (first rinsing step).

Thereafter, the automotive body 1, being carried by the hanger 45, is transported from the fourth rinsing station C2 to the rinse water removal station C3. In the rinse water removal station C3, when the roof 1*a* of the automotive body 1 passes the front of (below) the air outlet of each nozzle 60, the electromagnetic valve 64 associated with the nozzle 60 is opened to blow the air to the roof 1*a* (rinse water removal/reduction step). The blowing of the air removes away most of the rinse water remaining on the roof 1*a*. This advantageously keeps the first electrodeposition coating film from forming a recess therein in the subsequent thermal flow step. In a preferred embodiment, the rinse water is removed or reduced in a non-heating or low-temperature atmosphere so as not to unintentionally cause the first electrodeposition coating film to thermally flow. After the roof 1*a* has passed the front of (below) the air outlet of the nozzle 60, the blowing of the air stops. Note that, in the present embodiment, the blowing of the air stops while the gate-shaped frames 47, 48 of the hanger 45 are passing the front of (below) the air outlet of the nozzle 60. This avoids the oil or dust adhering to the hanger 45 from being blown by the air and adhering to the first electrodeposition coating film.

Subsequently, the automotive body 1, being carried by the hanger 45, is transported from the rinse water removal station C3 to the thermal flow station C4, and is sent to the warm air heating furnace 17 (tunnel furnace). While the automotive body 1 is passing through the warm air heating furnace 17, the first electrodeposition coating film on the outer plate portion of the automotive body 1 is heated by the warm air blown from the first warm air outlets 81 and the second warm air outlets 82, and is allowed to thermally flow (thermal flow step).

The first electrodeposition coating film is caused to thermally flow through blowing, to the automotive body 1, the warm air of a temperature lower than the baking temperature (150° C. to 180° C.) of the first electrodeposition coating film. Since the heating is performed not by radiation, but by the warm air, the rinse water, even if remaining on the surface of the first electrodeposition coating film, is quickly removed by the warm air. This advantageously keeps the first electrodeposition coating film from forming the recess in its surface.

In a preferred embodiment, the first electrodeposition coating film is allowed to thermally flow such that, for example, the first electrodeposition coating film formed on a portion of the automotive body 1 near the first counter electrodes 10 in the formation of the first electrodeposition coating film is heated at a temperature of 70° C. to 110° C. for a predetermined time (several minutes, in particular two minutes to five minutes, in the present embodiment). In the formation of the first electrodeposition coating film, if the first electrodeposition coating film formed on the portion of the automotive body 1 near the first counter electrodes 10 is heated at a temperature lower than 70° C., or heated for a shorter time than the predetermined time, the thermal flow of the first electrodeposition coating film formed on that portion occurs insufficiently, resulting in an insufficient increase in the electrical resistance of the first electrodeposition coating film formed on that portion. For this reason, in the formation of the second electrodeposition coating film, the second electrodeposition coating film is formed more easily on the portion of the automotive body 1 near the first counter electrodes 10. This is disadvantageous in the formation of the second electrodeposition coating film of a desired thickness on a portion of the automotive body 1 far from the first counter electrodes 10. On the other hand, if the heating is performed at a temperature higher than 110° C., or for a longer time than the predetermined time, the first electrodeposition coating film which is thinly formed on the portion of the automotive body 1 far from the first counter electrodes 10 becomes dense through the thermal flow, and in particular, increases its electrical resistance too much. This is disadvantageous for the formation of the second electrodeposition coating film on the portion far from the first counter electrodes 10.

Since the warm air from the second warm air outlets 82 is directed to the roof 1*a*, the rinse water, even if remaining on the roof 1*a*, rapidly evaporates. That is, the boundary between a portion of the roof 1*a* that is wet with the rinse water and a dry portion quickly disappears. Thus, the temperature of the first electrodeposition coating film increases substantially uniformly over the entire surface of the roof 1*a*. This make it possible to avoid the first electrodeposition coating film from locally forming a recess due to generation of a portion having a different volume shrinkage.

The warm air from the first and second warm air outlets 81, 82 hits the outer plate portion of the automotive body 1. This causes the first electrodeposition coating film on the outer plate portion to thermally flow, but supplies only a small amount of heat to the first electrodeposition coating film on the inner plate portion. Therefore, the first electrodeposition coating film on the inner plate portion thermally flows less than the first electrodeposition coating film on the outer plate portion. Almost no thermal flow occurs in the depths of the inner plate portion when viewed from the outer plate portion. Therefore, the first electrodeposition coating film on the outer plate portion has a higher electrical resistance than the first electrodeposition coating film on the inner plate portion.

Subsequently, the automotive body 1, being carried by the hanger 45, is transported from the thermal flow station C4 to the second electrodeposition station C5. In the second electrodeposition station C5, the automotive body 1 is immersed in the electrodeposition paint in the second electrodeposition tank 21, and a direct current voltage is applied between the automotive body 1 and the second counter electrodes 21*a*. Thus, the second electrodeposition coating film is formed on the outer and inner plate portions of the automotive body 1 (second electrodeposition step). In this case, since the previous thermal flow has made the electrical resistance of the first electrodeposition coating film on the outer plate portion higher than that of the first electrodeposition coating film on the inner plate portion, the electrodeposition paint in the second electrodeposition tank 21 adheres more to the inner plate portion than to the outer plate portion. Therefore, by controlling time for immersing the automotive body 1 in the electrodeposition paint in the second electrodeposition tank 21, the thicknesses of the electrodeposition coating layers on the inner and outer plate portions (the sum of the thicknesses of the first and second electrodeposition coating films) can be easily controlled to a desired one.

Thereafter, the automotive body 1, being carried by the hanger 45, is transported from the second electrodeposition station C5 to the fifth rinsing station C6. In the fifth rinsing station C6, the automotive body 1 is successively rinsed through spraying by the first to third spray nozzles 22 to 24, dipping in the first dipping tank 25, spraying by the fourth spray nozzle 26, dipping in the second dipping tank 27, and spraying by the fifth spray nozzle 28 (a second rinsing step).

Thereafter, the automotive body 1, being carried by the hanger 45, is transported from the fifth rinsing station C6 to the dehumidification station D1. In the dehumidification furnace D11 of the dehumidification station D1, the rinse water adhering to the surface of the automotive body 1, being transported, falls into drops by gravity. Further, the air is taken out from the dehumidification furnace D11, and the temperature/humidity control system controls the temperature and weight absolute humidity of the taken-out air to be about 80° C. and less than 22 g/kg, respectively. The air thus conditioned is then returned to the dehumidification furnace D11 so that the conditioned air hits the automotive body 1 as dry warm air. In this way, the humidity in the dehumidification furnace D11 is lowered while causing the dry warm air to hit the automotive body 1, so that the rinse water remaining on the surface of the automotive body 1 is gradually dried and removed (dehumidification step).

Thereafter, the automotive body 1, being carried by the hanger 45, is transported from the dehumidification station D1 to the baking/drying station D2. In the baking/drying furnace D21 of the baking/drying station D2, the automotive body 1 is heated to a baking temperature of 100° C. or higher to dry and cure the electrodeposition coating layer made of a stack of the first and second electrodeposition coating films and formed on the surface of the automotive body 1.

—Advantages—

In the rinse water removal/reduction step (rinse water removal station C3) performed between the first rinsing step (fourth rinsing station C2) of rinsing the automotive body 1 on which the first electrodeposition coating film has been formed and the thermal flow step (thermal flow station C4), the rinse water on the roof 1*a* (the rinse water stagnating surface), which is substantially horizontal, and thus, stagnating the rinse water thereon, of the automotive body 1 is removed or reduced. Thus, when the first electrodeposition coating film on the automotive body 1 is caused to thermally flow thereafter, the first electrodeposition coating film is kept from forming a recess in its surface. Even if the rinse water is not completely removed from the rinse water stagnating surface and partially remains thereon, the amount of the remaining rinse water is small. Thus, the rinse water rapidly evaporates through the heating for causing the thermal flow in the subsequent thermal flow step. That is, during the thermal flow, a large difference in volume shrinkage between the wet portion and dry portion of the first electrodeposition coating film does not last for a long time. This avoids the formation of the recess at the boundary between the wet portion and the dry portion. Even if the recess is formed, its depth is small. Thus, the second electrodeposition coating film formed after the thermal flow can be kept from becoming greatly uneven.

In the degreasing step (degreasing/cleaning station A2), the automotive body 1, which has been rinsed, but from the surface of which the dirt or the oil and fat content has not been removed yet, is immersed in the degreasing solution A12 stored in the degreasing tank A13, and the degreasing solution A12 is ultrasonically vibrated by the ultrasonic vibrators A14 provided on the bottom wall portion of the degreasing tank A13 to degrease and clean the automotive body 1. Therefore, the inner plate portion of the automotive body 1 can also be sufficiently degreased and cleaned in a short time, as compared to the cleaning using the pressure of sprayed water. This can keep the electrodeposition coating film from becoming uneven due to the dirt or the oil and fat content in the electrodeposition coating layer formation step after the degreasing step, and can shorten the duration (time) of the degreasing step. Accordingly, even if the double coating method is employed, the entire duration (time) of the electrodeposition coating line L can be made substantially equal to the entire duration of a conventional electrodeposition coating line in which the electrodeposition coating is performed once.

The dip-rinsing step and the spray-rinsing step (fourth rinsing station C2) can sufficiently rinse the automotive body 1 on which the first electrodeposition coating film has been formed. Thus, the subsequent rinse water removal/reduction step can be performed more effectively, which can satisfactorily keep the electrodeposition coating layer from becoming uneven.

Further, the thermal flow is caused in the thermal flow step through blowing, to the automotive body 1, the warm air having a temperature lower than the baking temperature of the first electrodeposition coating film. That is, the heating is performed not by radiation, but by the warm air. Therefore, the rinse water, if remaining on the surface of the first electrodeposition coating film, is quickly removed. This can keep the first electrodeposition coating film from forming a recess in its surface, and can keep the electrodeposition coating layer from becoming uneven more satisfactorily.

Further, the thermal flow is caused in the thermal flow step such that the first electrodeposition coating film formed on the portion of the automotive body 1 near the first counter electrodes 10 is heated at a temperature of 70° C. to 100° C. for a predetermined time (several minutes). Therefore, in the formation of the first electrodeposition coating film, the first electrodeposition coating film formed on the portion of the automotive body 1 near the first counter electrodes 10 has a higher electrical resistance than the first electrodeposition coating film formed on the portion of the automotive body 1 far from the first counter electrodes 10. As a result, by controlling the time for immersing the automotive body 1 in the electrodeposition paint in the second electrodeposition tank 21 in the formation of the second electrodeposition coating film, the electrodeposition coating layer having a desired thickness can be formed on each of the portions of the automotive body 1 near and far from the first counter electrodes 10.

If the baking/drying of the electrodeposition coating layer is performed after the second rinsing step (the fifth rinsing station C6) with the rinse water still remaining on the surface of the automotive body 1 (the surface of the electrodeposition coating layer), the surface of the electrodeposition coating layer becomes uneven, which makes the appearance poor. For this reason, the rinse water needs to be eliminated from the surface of the electrodeposition coating layer.

According to the present embodiment, in the dehumidification step (dehumidification station D1), the automotive body 1 having the electrodeposition coating layer whose surface has got wet through the rinsing is sent to the dehumidification furnace D11 to dry the rinse water. In the dehumidification furnace D11, the rinse water remaining on the surface of the automotive body 1 naturally falls in drops by gravity, which can remove most of the remaining rinse water. Further, an upstream portion of the air which has entered the dehumidification furnace D11 is taken out to lower its humidity, and the air that has its humidity lowered is returned to the dehumidification furnace D11 to lower the humidity in the dehumidification furnace D11. This can gradually dry the moisture adhering to the surface of the automotive body 1 without excessively increasing the surface temperature of the automotive body 1. This can keep the electrodeposition coating layer from having an uneven surface caused by traces of the remaining rinse water.

Further, in addition to the natural fall of the rinse water by gravity, the humidity in the dehumidification furnace D11 is lowered to dry the rinse water remaining on the surface of the automotive body 1. Thus, the remaining rinse water can be removed more quickly than in the case where the rinse water is removed only through the natural fall by gravity. This can shorten the duration of the dehumidification step, and hence can easily make the entire duration of the electrodeposition coating line L substantially the same as the entire duration of a conventional electrodeposition coating line in which the electrodeposition coating is performed once.

The humidity in the dehumidification furnace D11 can be lowered through exchanging the air in the dehumidification furnace D11 with the outside air. However, this method leads to loss of energy because the high-temperature air is discharged to the outside.

In the present embodiment, the air taken out from the dehumidification furnace D11 is cooled and heated using the heat pump, and the heated air is returned to the dehumidification furnace D11 to dehumidify the dehumidification furnace D11. This can reduce the energy loss.

Further, the drops fallen from the automotive body 1 and the condensation water generated through the cooling of the air by the cooler 93 are stored as the stored water in the reservoir 96*a* in the dehumidification furnace D11. The stored water passes through the filter D17 to be used as the rinse water in the fifth rinsing station C6. Thus, the drops and the condensation water discharged from the dehumidification furnace D11 can be reused.

Further, the drops and the condensation water discharged from the dehumidification furnace D11 contain almost no dust or dirt mixed from the outside. Thus, the dirt in the drops and the condensation water can be removed using the filter D17 having a simple configuration. Then, the drops and the condensation water that have passed through the filter D17 are returned to the first dipping tank 25, and then the overflow from the first dipping tank 25 and the rinse liquid recovery tanks 33, 34 is recovered to the second electrodeposition tank 21. Then, the electrodeposition paint is recovered by the UF device 31 connected to the second electrodeposition tank 21, so that the electrodeposition paint can be reused.

Other Embodiments

The present invention is not limited to this embodiment. Any change can be made within the scope of the claims as appropriate.

As the hanger for transporting the automotive body, a C-shaped hanger that supports the automotive body 1 from one side in the vehicle width direction may be adopted. In this case, in the rinse water removal station C3, the second air supply pipes 57 to 59 are arranged at a position across the automotive body 1 from the C-shaped hanger, and air supply pipes are extended from the second air supply pipes 57 to 59 toward a mid-height position between a position where an upper frame of the C-shaped hanger passes and a position where the roof 1*a* of the automotive body 1 passes, so that the nozzles 60 can be arranged at the mid-height position. In this configuration, the upper frame of the hanger does not pass the front of (below) the nozzles 60. Thus, the air can be continuously blown to the roof 1*a* even when the roof 1*a* passes the front of (below) the nozzles 60.

If the C-shaped hanger is employed, warm air blowing pipes in the thermal flow station C4, as well, can be extended from a position across the automotive body 1 from the C-shaped hanger toward the mid-height position between the position where the upper frame of the C-shaped hanger passes and the position where the roof 1*a* of the automotive body 1 passes. This makes it possible to orient the second warm air outlets 82 downward just above the position where the roof 1*a* passes, and thus, advantageously evaporates and removes the rinse water remaining on the roof 1*a*.

In the above embodiment, the degreasing/cleaning is performed in the degreasing/cleaning station A2 using the degreasing tank A13 in which the plurality of ultrasonic vibrators A14 are arranged. However, a degreasing tank having no ultrasonic vibrators may also be employed.

In the above embodiment, the air is blown to the roof 1*a* in the rinse water removal station C3. However, the removal of the rinse water may be performed by any other method than blowing the air as long as the rinse water is removed from the roof 1*a*.

In the above embodiment, the nozzle 60 is attached to one of the three nozzle mounts 55*a* of each nozzle mounting tube 55 in the rinse water removal accelerator 8. However, the nozzle 60 may be attached to each of the plurality of nozzle mounts 55*a*.

Further, in the above embodiment, the surface conditioning station B1 is provided. However, the surface conditioning station B1 may or may not be provided as needed.

Further, in the above embodiment, a zinc phosphate-based treatment liquid is used as the chemical conversion solution in the chemical conversion station B2, but other solutions, such as a zirconium oxide-based treatment solution, may be used.

In the above embodiment, the pre-cooler D12 and the post-heater D14 are provided, but either one or both of the pre-cooler D12 and the post-heater D14 may be omitted.

Further, in the above embodiment, the stored water discharged from the dehumidification furnace D11 is recovered to the first dipping tank 25, but it may not be recovered.

Further, in the above embodiment, the target object to be coated by the electrodeposition coating apparatus E has been described as the automotive body 1. However, the target object may be any other article.

The foregoing embodiment is merely a preferred example in nature, and the scope of the present invention should not be interpreted in a limited manner. The scope of the present invention is defined by the appended claims, and all variations and modifications belonging to a range equivalent to the range of the claims are within the scope of the present invention.

INDUSTRIAL APPLICABILITY

The present invention is useful for an electrodeposition coating method and an electrodeposition coating apparatus that apply an electrodeposition paint to a target object in two steps.

DESCRIPTION OF REFERENCE CHARACTERS

A Degreasing/Cleaning Area (Degreasing/Cleaning Device)
A12 Degreasing Solution
A13 Degreasing Tank (Degreasing Device)
A14 Ultrasonic Vibrator (Degreasing Device)
B Chemical Conversion Area (Chemical Conversion Device)
C Electrodeposition Coating Area (Electrodeposition Coating Layer Formation device)
D11 Dehumidification Furnace
D13 Heat Pump
D16 Circulation Path
D17 Filter
E Electrodeposition Coating Apparatus
L Electrodeposition Coating Line
M Dehumidifier
1 Automotive Body (Target Object)
1*a* Roof (Rinse Water Stagnating Surface)
8 Rinse Water Removal Accelerator (Rinse Water Removal/Reduction Device)
10 First Counter Electrode
11 First Electrodeposition Tank (First Electrodeposition Device)
12 Dipping Tank (First Rinsing Device)
13 Spray Nozzle (First Rinsing Device)
16 Coating Thermal Flow Device (Thermal Flow Device)
21 Second Electrodeposition Tank (Second Electrodeposition Device)
22 First Spray Nozzle (Second Rinsing Device)
23 Second Spray Nozzle (Second Rinsing Device)
24 Third Spray Nozzle (Second Rinsing Device)
25 First Dipping Tank (Second Rinsing Device)
26 Fourth Spray Nozzle (Second Rinsing Device)
27 Second Dipping Tank (Second Rinsing Device)
28 Fifth Spray Nozzle (Second Rinsing Device)
31 UF Device (Ultrafiltration Device)
93 Cooler
94 Heater

The invention claimed is:

1. An electrodeposition coating method, comprising:

a degreasing/cleaning step of removing dirt or an oil and fat content on a surface of a target object to be coated;

a chemical conversion step, performed after the degreasing/cleaning step, of forming a chemical conversion layer on the surface of the target object from which the dirt or the oil and fat content has been removed; and an electrodeposition coating layer formation step, performed after the chemical conversion step, of forming an electrodeposition coating layer including a first electrodeposition coating film and a second electrodeposition coating film stacked on the first electrodeposition coating film on the surface of the target object on which the chemical conversion layer has been formed, wherein the degreasing/cleaning step includes a degreasing step of degreasing and cleaning the target object, from the surface of which the dirt or the oil and fat content has not been removed yet, through ultrasonically vibrating a degreasing solution which is stored in a degreasing tank and in which the target object is immersed, using an ultrasonic vibrator provided on a wall portion of the degreasing tank, and the electrodeposition coating layer formation step includes:

a first electrodeposition step of forming, in a first electrodeposition tank, the first electrodeposition coating film on the target object through application of a direct current voltage between the target object on which the chemical conversion layer has been formed and a first counter electrode;

a first rinsing step of rinsing, after the first electrodeposition step, the target object on which the first electrodeposition coating film has been formed with rinse water;

a rinse water removal/reduction step of removing or reducing, after the first rinsing step, the rinse water remaining on a rinse water stagnating surface of the target object that has been rinsed, the rinse water stagnating surface being substantially horizontal and thus stagnating the rinse water thereon;

warm air blowing step of blowing warm air on the target object after the rinse water removal/reduction step such that, on the target object having gone through the removal or reduction of the rinse water on the rinse water stagnating surface, the first electrodeposition coating film formed on a portion of the target object near the first counter electrode has a higher electrical resistance than the first electrodeposition coating film formed on a portion of the target object far from the first counter electrode; and a second electrodeposition step of forming, in a second electrodeposition tank after the warm air blowing step, the second electrodeposition coating film on the target object on which the warm air has blown, through application of a direct current voltage between the target object and a second counter electrode.

2. The electrodeposition coating method of claim 1, wherein the rinse water removal/reduction step is a step of blowing a gas to the rinse water stagnating surface to eliminate the rinse water from the rinse water stagnating surface.

3. The electrodeposition coating method of claim 1, wherein the first rinsing step includes:

a dip-rinsing step of immersing the target object on which the first electrodeposition coating film has been formed in the rinse water stored in a dipping tank; and a spray-rinsing step of spraying, before or after the dip-rinsing step, the rinse water on the target object on which the first electrodeposition coating film has been formed.

4. The electrodeposition coating method of claim 1, wherein in the warm air blowing step, the warm air has a lower temperature than a baking temperature of the first electrodeposition coating film to the target object.

5. The electrodeposition coating method of claim 4, wherein in the warm air blowing step, the first electrodeposition coating film formed on the portion of the target object near the first counter electrode is heated at 70° C. to 100° C. for a predetermined time.

6. The electrodeposition coating method of claim 1, wherein the electrodeposition coating layer formation step includes a second rinsing step of rinsing, after the second electrodeposition step, the target object on which the second electrodeposition coating film has been formed with rinse water, and the electrodeposition coating method further includes, after the second rinsing step, a dehumidification step of sending the target object having the electrodeposition coating layer whose surface is wet with the rinse water to a dehumidification furnace, taking air out from the dehumidification furnace to lower humidity of the taken-out air while allowing the rinse water to fall in drops in the dehumidification furnace, and returning the air that has its humidity lowered to the dehumidification furnace, thereby drying the rinse water on the surface of the target object.

7. The electrodeposition coating method of claim 6, wherein a heat pump is provided in advance, the heat pump using the air taken out from the dehumidification furnace as a heat absorption source, and the air cooled through heat absorption as a heat radiation source, and the dehumidification step includes:

a cooling step of taking the air out from the dehumidification furnace and cooling the taken-out air using the heat pump such that part of moisture in the taken-out air is condensed as condensation water; and a heating step of heating the cooled air and returning the heated air to the dehumidification furnace using the heat pump.

8. The electrodeposition coating method of claim 7, wherein the drops and the condensation water are used as the rinse water in the second rinsing step.

9. The electrodeposition coating method of claim 6, wherein the air returned to the dehumidification furnace has a temperature lower than 100° C.

10. The electrodeposition coating method of claim 1, wherein the target object is an automotive body, and the rinse water stagnating surface is a roof of the automotive body.

* * * * *